US009221577B2

(12) United States Patent
Curtis et al.

(10) Patent No.: US 9,221,577 B2
(45) Date of Patent: Dec. 29, 2015

(54) PACKAGING SYSTEM FOR TOILET COMPONENTS

(71) Applicant: Masco Corporation of Indiana, Indianapolis, IN (US)

(72) Inventors: Paul Curtis, Ramsgate (GB); David Ringholz, Noblesville, IN (US)

(73) Assignee: Delta Faucet Company, Indianapolis, IN (US)

( * ) Notice: Subject to any disclaimer, the term of this patent is extended or adjusted under 35 U.S.C. 154(b) by 0 days.

(21) Appl. No.: 14/326,519

(22) Filed: Jul. 9, 2014

(65) Prior Publication Data

US 2015/0014208 A1 Jan. 15, 2015

Related U.S. Application Data

(60) Provisional application No. 61/844,856, filed on Jul. 10, 2013.

(51) Int. Cl.

| | |
|---|---|
| ***B65D 5/50*** | (2006.01) |
| ***B65B 5/12*** | (2006.01) |
| ***B65B 7/18*** | (2006.01) |
| ***E03D 11/00*** | (2006.01) |

(52) U.S. Cl.

CPC ..... *B65D 5/5035* (2013.01); *B65B 5/12* (2013.01); *B65B 7/18* (2013.01); *B65D 5/505* (2013.01); *B65D 5/5059* (2013.01); *E03D 11/00* (2013.01); *E03D 2201/00* (2013.01)

(58) Field of Classification Search

CPC .. B65D 5/5035; E03D 11/00; E03D 2201/00; B65B 5/12; B65B 7/18

USPC ..... 206/320, 521, 586, 592, 593, 588, 525; 229/117.23

See application file for complete search history.

(56) References Cited

U.S. PATENT DOCUMENTS

| | | | | | |
|---|---|---|---|---|---|
| 1,667,887 | A | * | 5/1928 | Fallert | 206/320 |
| 2,509,447 | A | * | 5/1950 | Prawdzik | 206/320 |
| 3,108,731 | A | * | 10/1963 | Royce | 206/591 |
| 4,574,998 | A | * | 3/1986 | Vavra | 229/103.2 |
| 5,183,155 | A | | 2/1993 | Vavra | |
| 5,287,968 | A | | 2/1994 | Ridgeway | |
| 5,328,027 | A | * | 7/1994 | Hollar et al. | 206/320 |
| 5,348,157 | A | | 9/1994 | Pozzo | |
| 5,462,218 | A | * | 10/1995 | Grigsby et al. | 229/122.22 |
| 5,690,232 | A | | 11/1997 | Emery | |
| 5,899,336 | A | * | 5/1999 | Kataoka | 206/592 |
| 6,047,414 | A | | 4/2000 | Bailey | |
| 6,079,563 | A | * | 6/2000 | Katchmazenski | 206/583 |
| 6,149,009 | A | * | 11/2000 | DeNola | 206/586 |
| 6,915,905 | B2 | | 7/2005 | Yoshimura | |
| 6,976,587 | B2 | | 12/2005 | Liverman et al. | |
| 8,522,971 | B2 | * | 9/2013 | Lachman | 206/321 |
| 2002/0104772 | A1 | | 8/2002 | Hnatow | |
| 2004/0089585 | A1 | | 5/2004 | Gosis et al. | |
| 2013/0008812 | A1 | * | 1/2013 | Swart et al. | 206/320 |

OTHER PUBLICATIONS

Cynosure Sanitary Two Piece Toilet (CY2065) (http://cynosure.en.alibaba.com/product/508058128-213031135/Sanitary_Two_Piece_Toilet_CY2065_.html), Jul. 9, 2013.

* cited by examiner

*Primary Examiner* — Steven A. Reynolds

(74) *Attorney, Agent, or Firm* — Faegre Baker Daniels LLP

(57) ABSTRACT

A packaging system for toilet components, including a toilet bowl, a toilet tank and a tank lid. The packaging system includes an outer carton, a location fitment, a tank protection member, a toilet lid pack, a toilet end fitment, a toilet lid fitment, and a top bowl fitment.

20 Claims, 36 Drawing Sheets

PACKAGING SYSTEM FOR TOILET COMPONENTS

CROSS-REFERENCE TO RELATED APPLICATION

This application claims priority to U.S. Provisional Patent Application Ser. No. 61/844,856, filed Jul. 10, 2013, the disclosure of which is expressly incorporated herein by reference.

BACKGROUND AND SUMMARY OF THE INVENTION

The present invention relates generally to packaging and, more particularly, to a packaging system for toilet components.

Packaging and associated logistics costs for sanitary ware, such as porcelain toilets, may be considerable. More particularly, shipping and inventory costs are directly related to the size of the packaging. Additionally, packaging must be sufficient to protect the fragile sanitary ware components.

The present disclosure relates to a packaging system for toilet components, including a toilet bowl, a toilet tank and a tank lid. The volume defined by the packaging system is reduced through orientation of the toilet bowl, and placement of the toilet tank and the tank lid relative to the toilet bowl. The orientation and placement of the toilet components reduce the external dimensions of the outer carton such that shipping and inventory costs are also reduced. This is accomplished by providing more packaged toilets in a standard container or truck. The reduced size also allows more packaged toilets to be stored in the same amount of inventory space.

The present disclosure provides for a packaging system that orients a toilet bowl at an angle from longitudinal and lateral axes of an outer carton, orients the toilet tank laterally adjacent the toilet bowl in an inverted position along a side wall of the carton, and places the tank lid along an end wall of the carton. The packaging system of the present disclosure takes advantage of the geometry of the toilet bowl and toilet tank, arranges the tank upside down so that the wide top of the tank is substantially in the same plane as the narrow foot or mounting base of the bowl, and the wide rim of the bowl is on the same plane as the narrow bottom of the tank. This is in contrast to conventional packaging arrangements where the toilet bowl and the tank are typically positioned within an outer carton in an assembled state. The arrangement of the present disclosure reduces the overall size of the packaging by approximately 27% over conventional arrangements, while providing adequate protection to the fragile porcelain toilet components during shipping and handling.

According to an illustrative embodiment of the present disclosure, a packaging system for toilet components includes an outer carton having a bottom wall, opposing first and second side walls extending upwardly from the bottom wall, a front end wall extending between the first and second side walls, and a rear end wall in spaced relation to the front end wall and extending between the first and second side walls. A carton longitudinal axis extends substantially parallel to the first and second sidewalls, and a carton lateral axis extends perpendicular to the carton longitudinal axis. A location fitment is supported above the bottom wall of the outer carton and is configured orient a mounting base of a toilet bowl within the outer carton. A tank protective member is supported within the outer carton and is configured to be positioned intermediate the toilet bowl and a toilet tank. A tank lid pack is positioned intermediate the front end wall of the outer carton and a front of the toilet bowl. A toilet seat pack is positioned intermediate the first side wall of the outer carton and a first side of the toilet bowl. A toilet end fitment is positioned intermediate the rear end wall of the outer carton and a rear of the toilet bowl. A tank lid fitment is positioned intermediate the second side wall of the outer carton and a second side of the toilet bowl. A top bowl fitment is positioned above the toilet bowl.

According to a further illustrative embodiment of the present disclosure, a packaging system for toilet components includes an outer carton having a bottom wall, opposing first and second side walls extending upwardly from the bottom wall, a front end wall extending between the first and second side walls, and a rear end wall in spaced relation to the front end wall and extending between the first and second side walls. A carton longitudinal axis extends substantially parallel to the first and second sidewalls, and a carton lateral axis extends perpendicular to the carton longitudinal axis. A location fitment is supported above the bottom wall of the outer carton and includes an opening configured to orient a mounting base of a toilet bowl within the outer carton. The opening of the location fitment defines a location fitment longitudinal axis. The location fitment longitudinal axis is angled relative to the carton longitudinal axis by an acute angle.

According to another illustrative embodiment of the present disclosure, a method of packaging toilet components includes the steps providing an outer carton, placing a location fitment within a bottom of the outer carton, and placing a tank fitment on a toilet tank. The method further includes the steps of placing the toilet tank in an inverted position within the outer carton such that an upper portion of the toilet tank is supported adjacent a bottom wall of the carton below a lower portion of the toilet tank, and inserting a mounting base of the toilet bowl within a recess in the location fitment such that the toilet bowl is angled relative to a longitudinal axis of the outer carton.

Additional features and advantages of the present invention will become apparent of those skilled in the art upon consideration of the following detailed description of the illustrative embodiments exemplifying the best mode of carrying the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
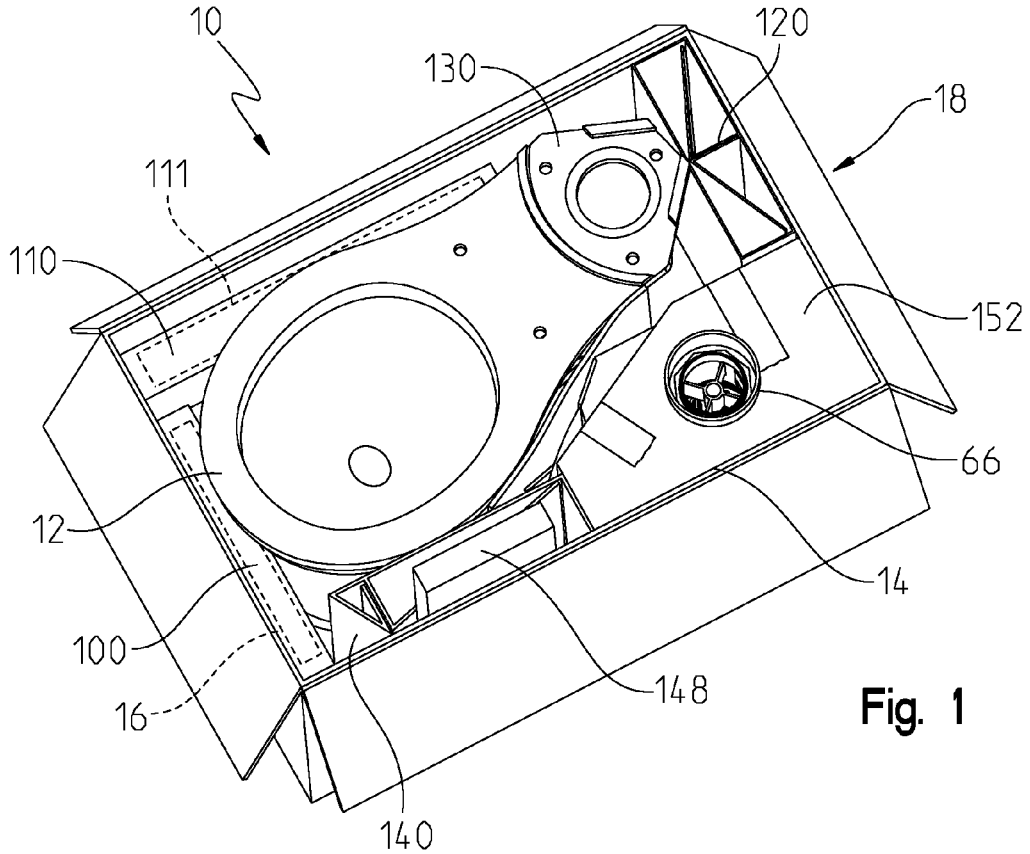
FIG. 1 is a perspective view of toilet components placed within an illustrative packaging system of the present disclosure.

Referring initially to FIG. 1, an illustrative packaging system 10 of the present disclosure for use with toilet components is illustrated. The packaging system 10 is configured to contain and protect from damage toilet components and accessories, including a toilet bowl 12, a toilet tank 14 and tank lid 16. In the illustrative embodiment, the toilet bowl 12, the toilet tank 14 and the tank lid 16 may be formed of porcelain, which is known to require protection from breakage during shipping.

The packaging system 10 of the present disclosure includes reduced dimensions, and resulting reduced internal volume, compared to conventional toilet packaging systems for similar sized toilet components. The present packaging system 10 illustratively defines a reduced dimensional envelope having outer length, width and height dimensions of approximately 31 inches, 20 inches and 18 inches, respectively.

FIGS. 2-15 are perspective views of the packaging system 10 in various stages of assembly, while FIGS. 16-25 are various views of the cardboard components of the packaging system 10 in different unfolded and folded configurations. In FIGS. 16-25, hidden lines are used to represent score or fold lines formed within the cardboard components.

Figure 2:
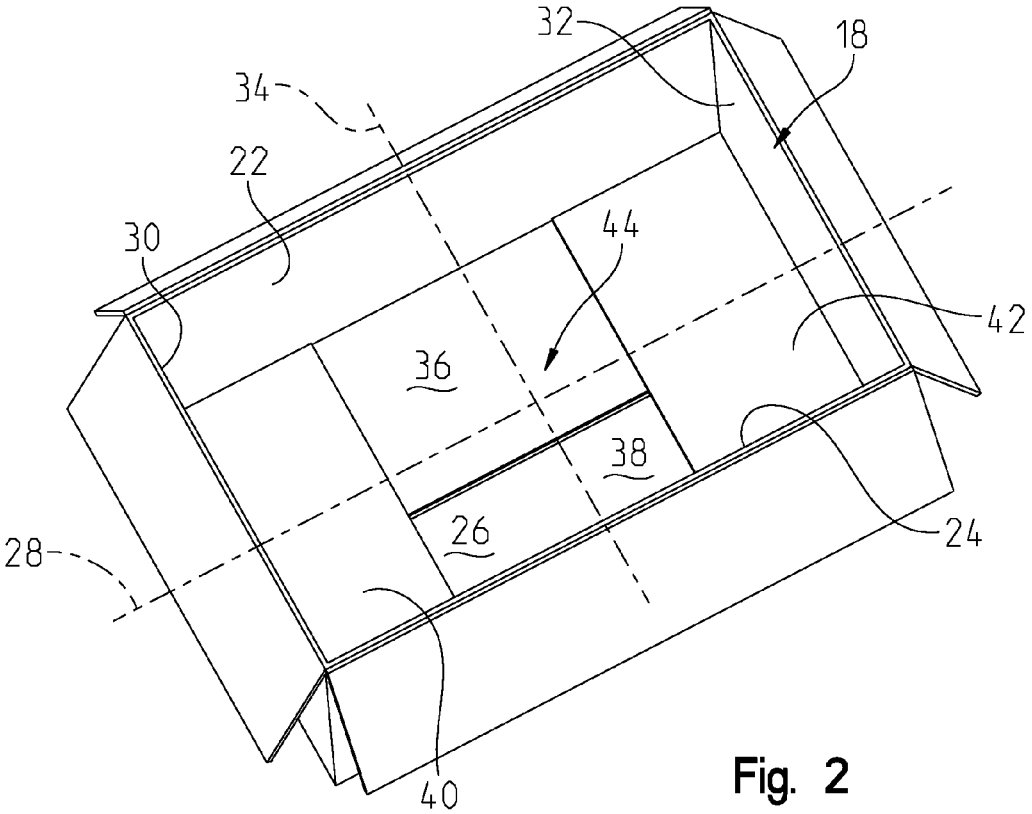
FIG. 2 is a perspective view of an empty outer carton of the packaging system of FIG. 1.
Figure 16:
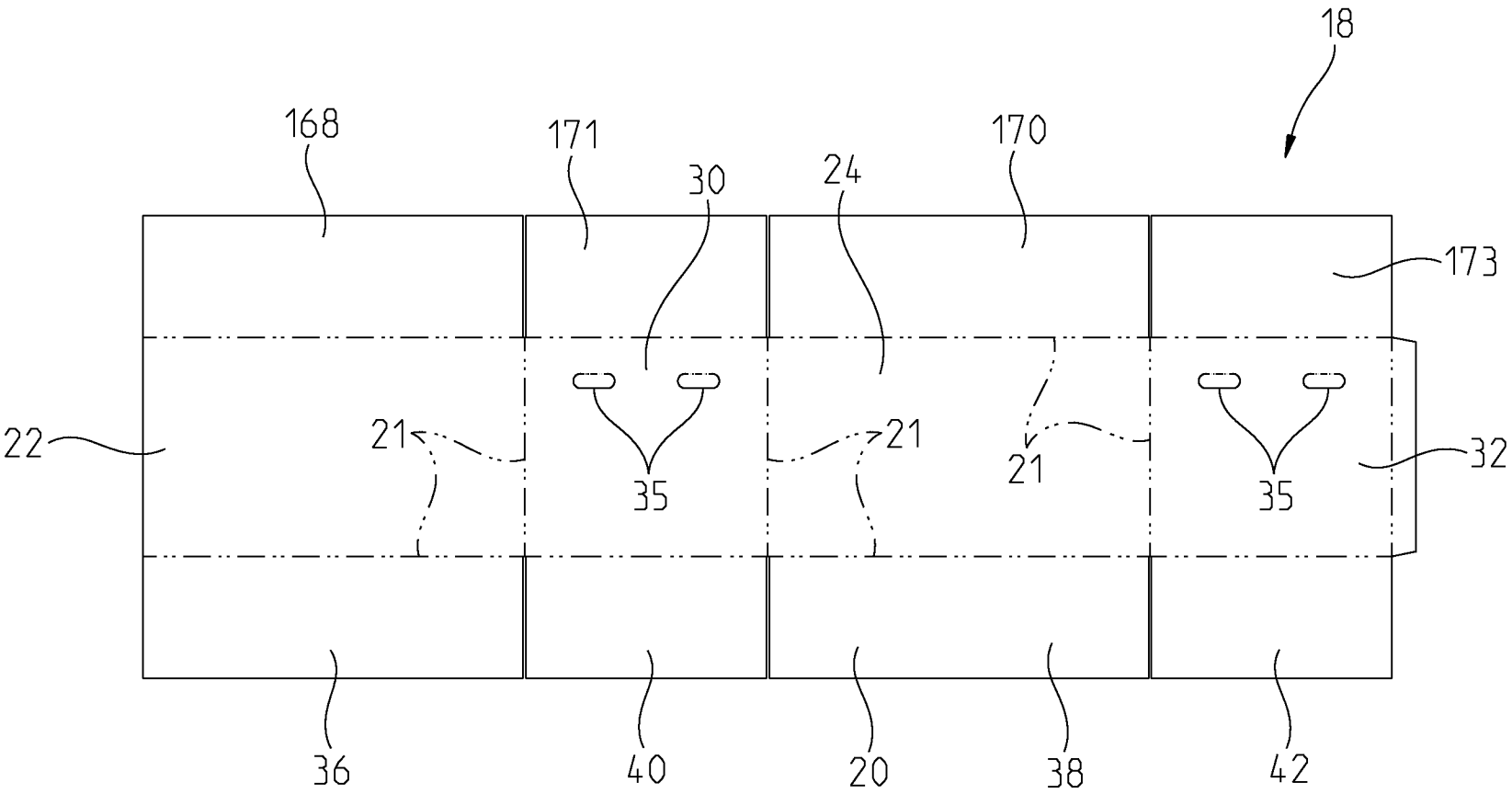
FIG. 16 is a plan view of an unfolded cardboard blank for use in making the outer carton of FIG. 2.

FIGS. 2 and 16 illustrate an outer carton 18 formed of a cardboard blank 20. When folded along score of folds lines 21, the cardboard blank 20 defines carton 18 including opposing first and second side walls 22 and 24 extending upwardly from a bottom wall 26. The side walls 22 and 24 illustratively extend parallel to each other and define a carton longitudinal axis 28. Opposing front and rear end walls 30 and 32 extend between the first and second side walls 22 and 24 in spaced relation to each other. The end walls 30 and 32 illustratively extend parallel to each other and define a carton lateral axis 34 extending perpendicular to the carton longitudinal axis 28. Handhold opening 35 may be formed within the end walls 30 and 32.

Figure 3:
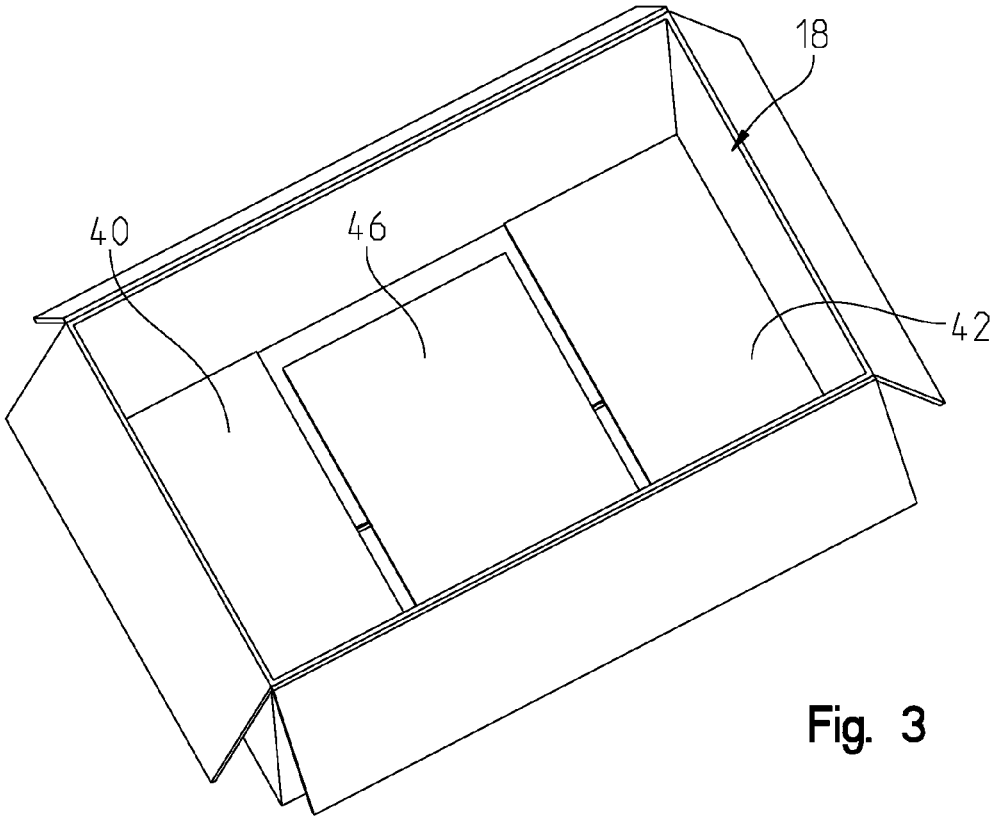
FIG. 3 is a perspective view of a base pad placed within the carton of FIG. 2.
Figure 17:
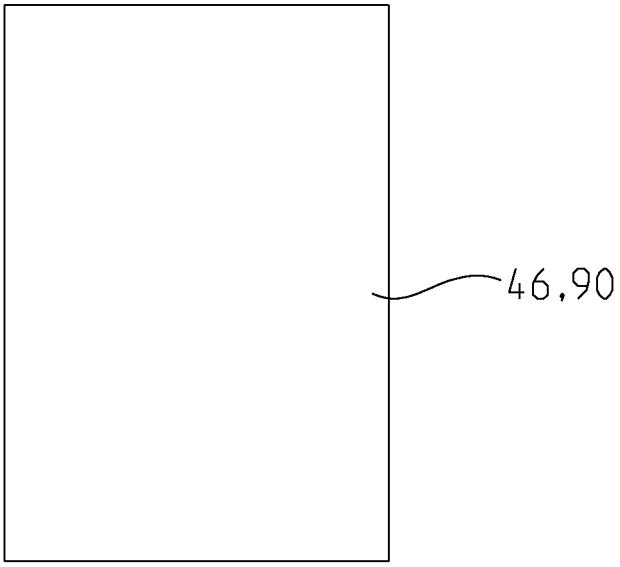
FIG. 17 is a plan view of the base pad of FIG. 3.

The bottom wall 26 of carton 18 is illustratively formed by flaps 36, 38, 40 and 42 defining a recess 44. With reference to FIGS. 3 and 17, a base pad 46 is received within the recess 44 and is illustratively formed of corrugated cardboard. The base pad 46 provides a level support surface for internal components of the carton 18.

Figure 4:
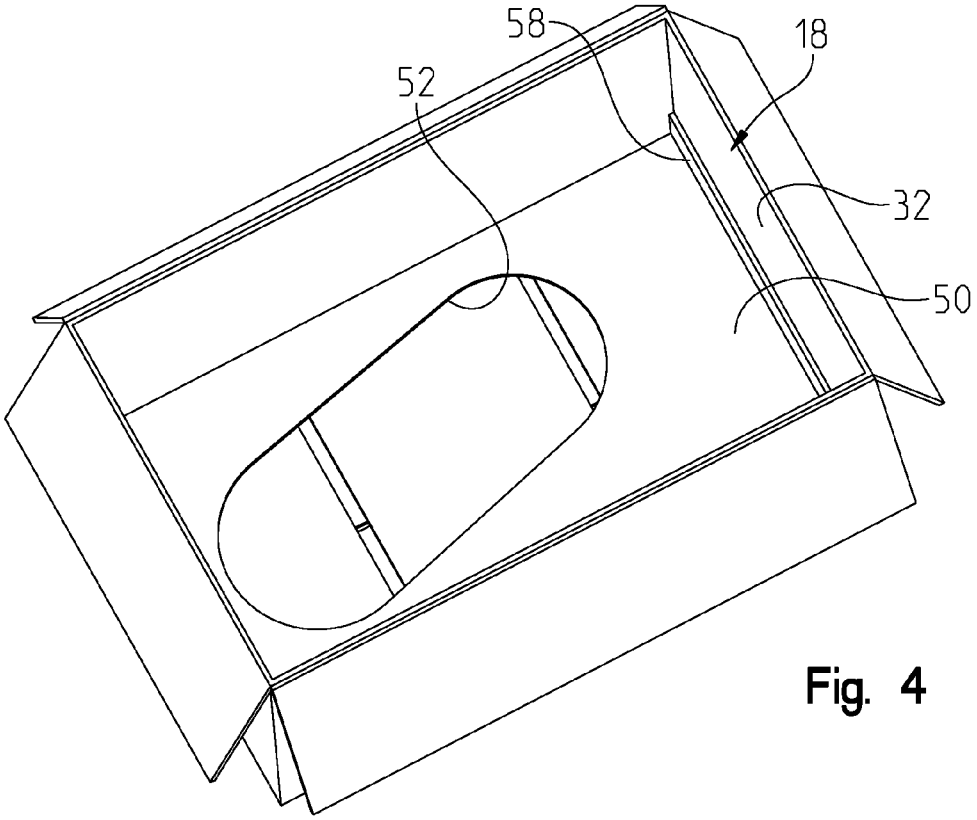
FIG. 4 is a perspective view showing a location fitment placed within the carton of FIG. 3.
Figure 18:
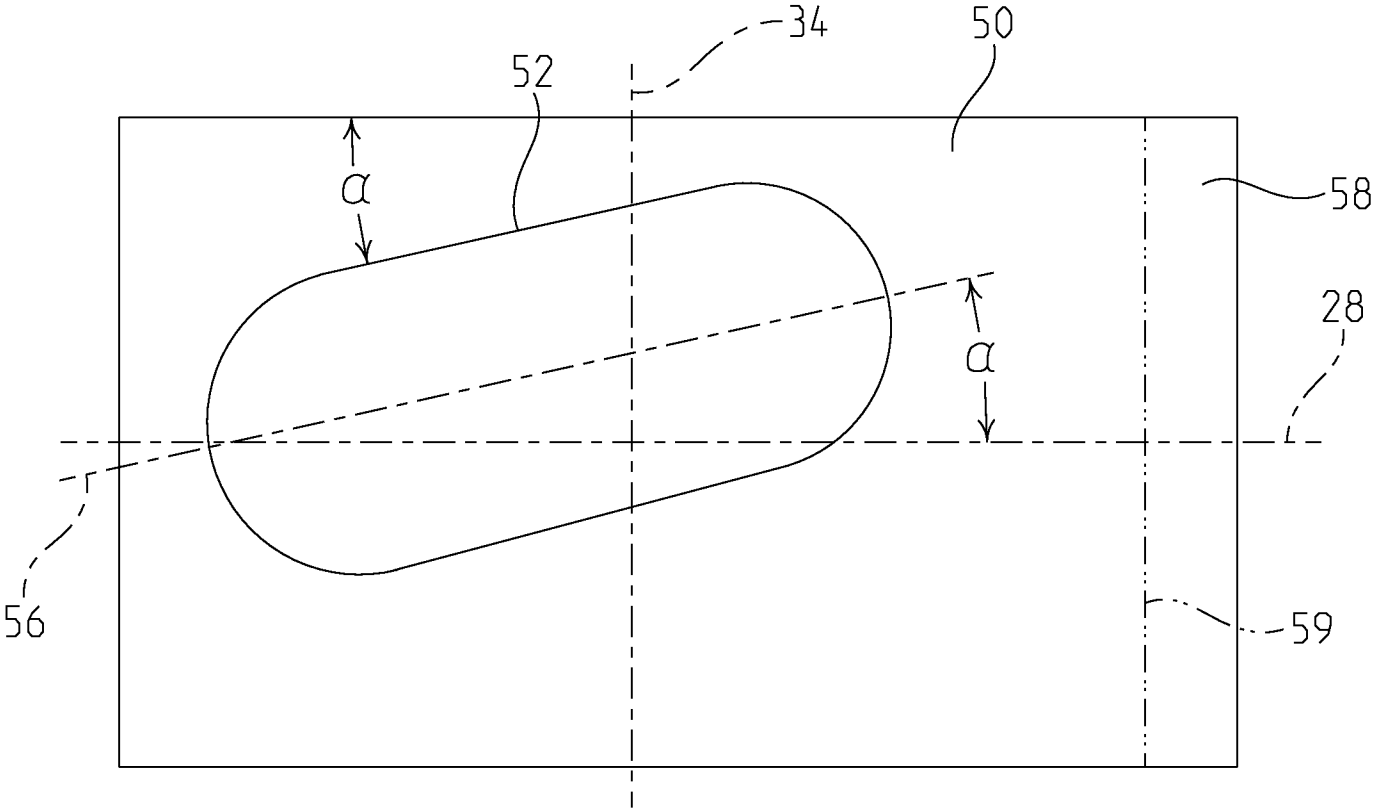
FIG. 18 is a plan view of the location fitment of FIG. 4.
Figure 19:
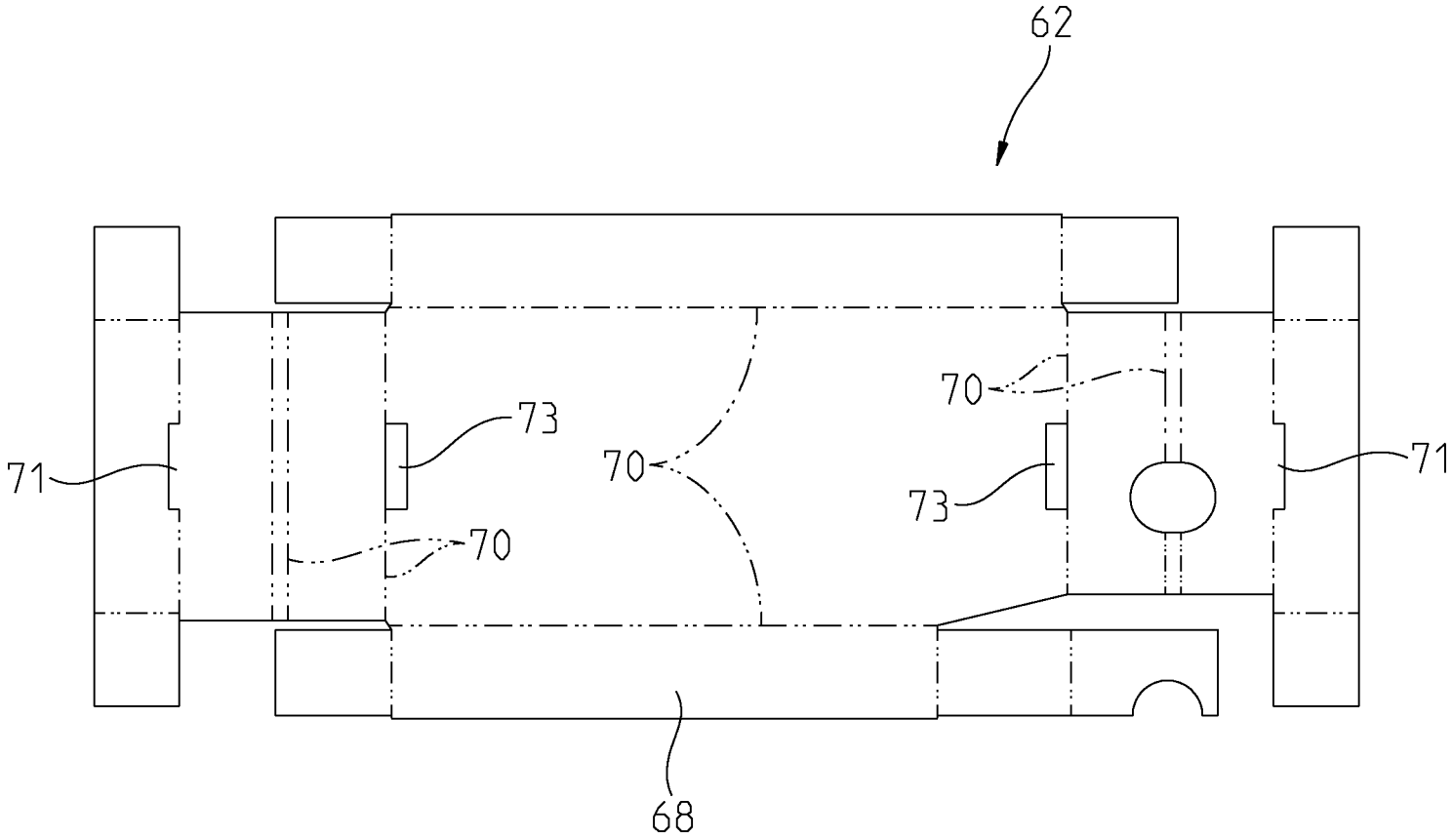
FIG. 19 is a plan view of an unfolded cardboard blank used in making the tank top fitment of FIG. 5.

With reference to FIGS. 4 and 18, a location fitment 50 is supported above the bottom wall 26 and the base pad 46. The location fitment 50 is illustratively formed of corrugated cardboard, and includes an opening 52 for receiving and orienting a lower portion or mounting base 54 of the toilet bowl 12. The opening 52 is configured to orient the toilet bowl 12 at an angle intermediate the carton longitudinal axis 28 and the carton lateral axis 34. In an illustrative embodiment, the angle $\alpha$ between the location fitment longitudinal axis 56 defined by the opening 52 and the carton longitudinal axis 28 as shown in FIG. 18 is an acute angle, illustratively of approximately 13 degrees. A locator flap 58 may be folded at an end of the location fitment 50 along a score or fold line 59 and, when assembled, rests against end wall 32 of the carton 18.

Figure 20:
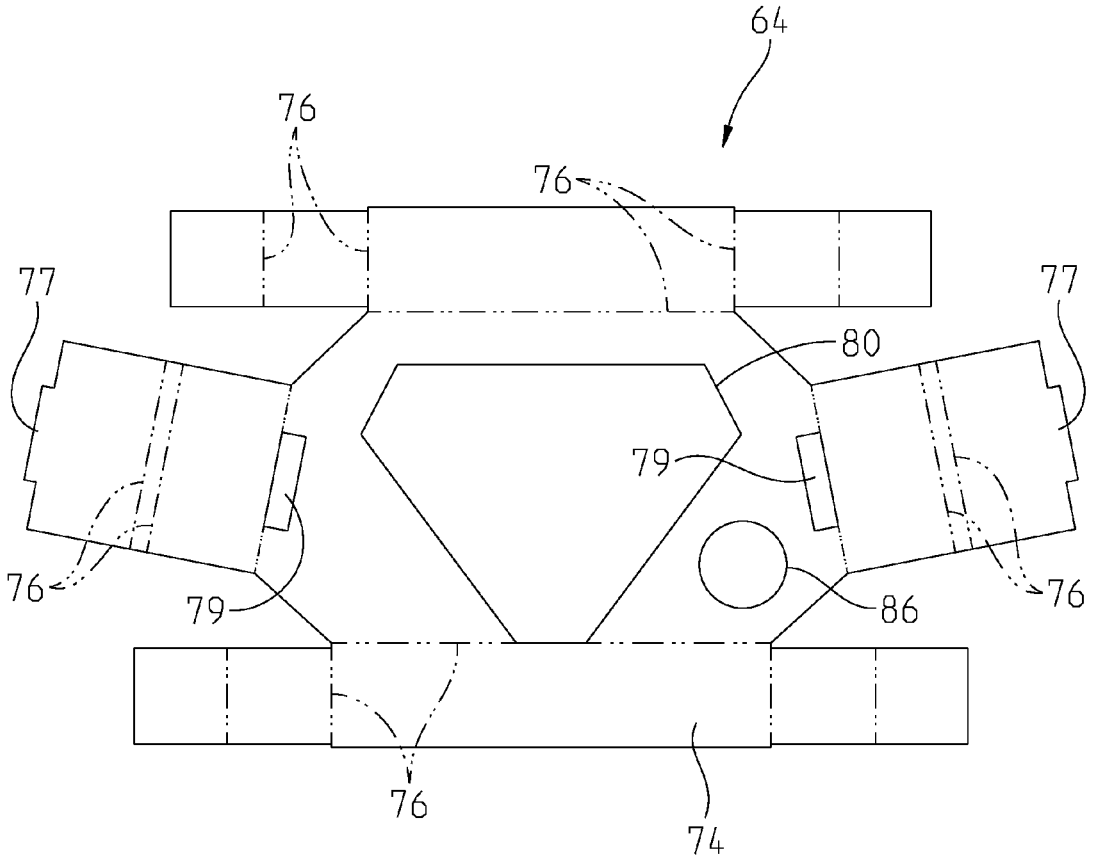
FIG. 20 is a plan view of an unfolded cardboard blank used in making the tank base fitment of FIG. 5.
Figure 21A:
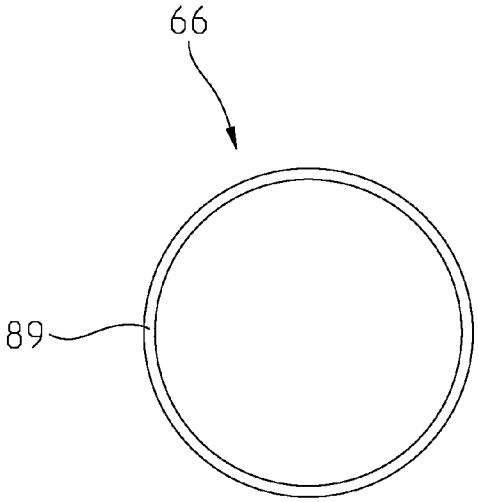
FIG. 21A is a top plan view of the tank outlet fitment of FIG. 14.
Figure 21B:
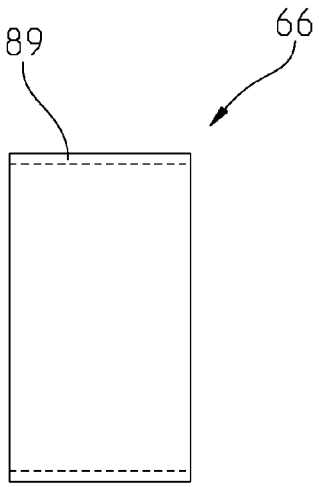
FIG. 21B is a side elevational view of the tank outlet fitment of FIG. 21A.
Figure 22A:
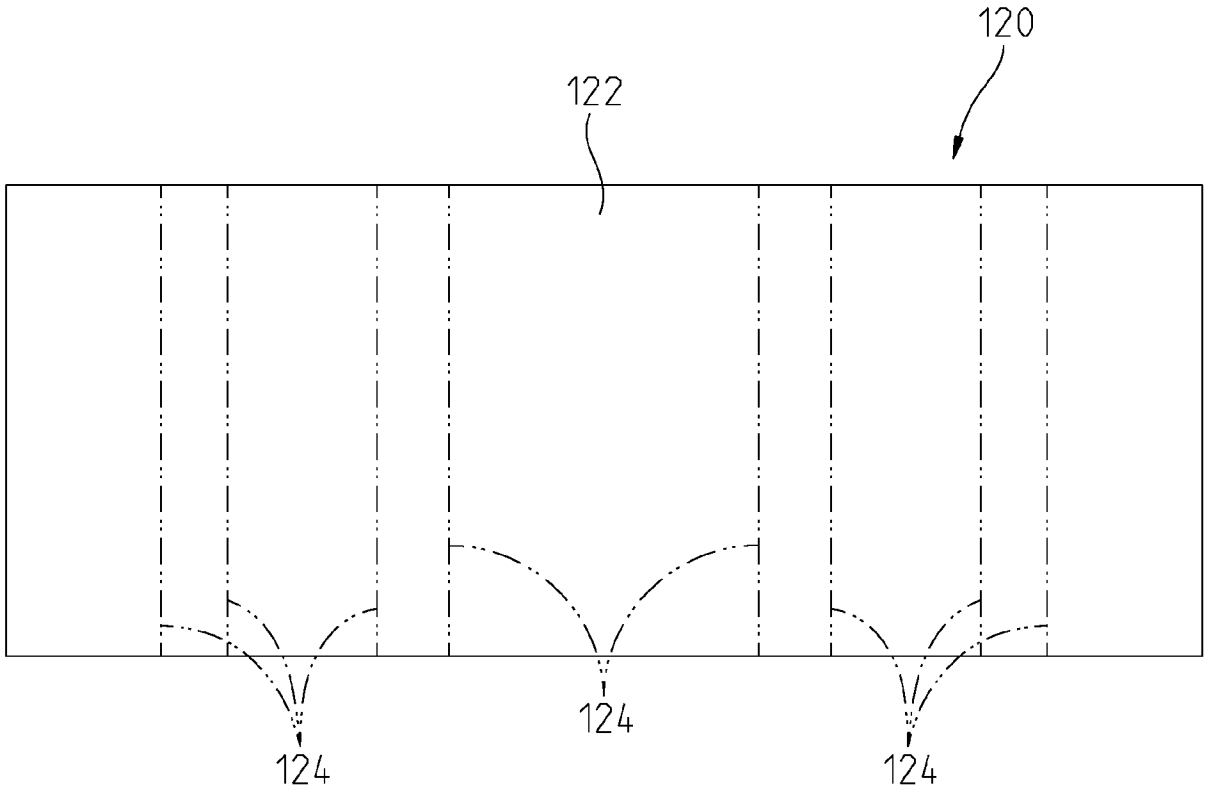
FIG. 22A is a plan view of an unfolded cardboard blank used in making the toilet end fitment of FIG. 10.
Figure 22B:
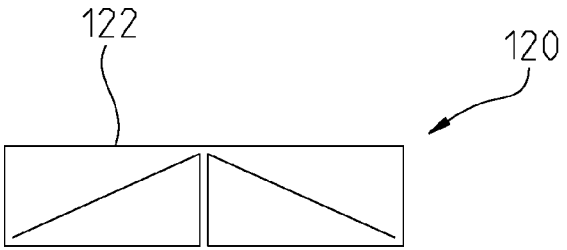
FIG. 22B is a top plan view of the cardboard blank of FIG. 22A folded into the toilet end fitment of FIG. 10.
Figure 23B:
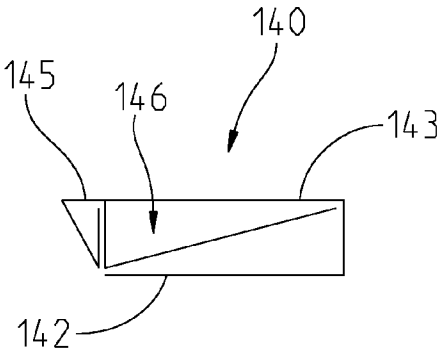
FIG. 23B is a top plan view of the cardboard blank of FIG. 23A folded into the tank lid fitment of FIG. 11.
Figure 23C:
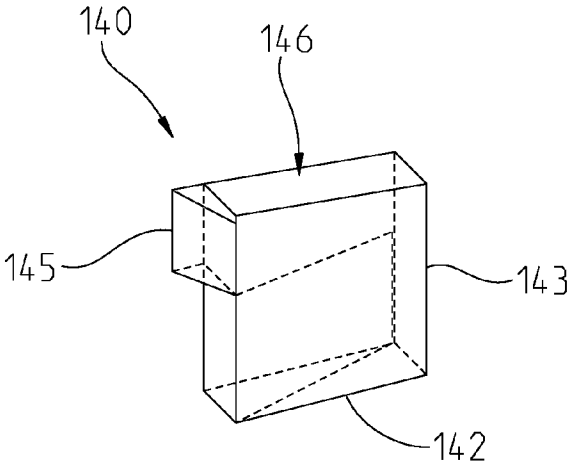
FIG. 23C is a perspective view of the folded tank lid fitment of FIG. 23B.
Figure 23A:
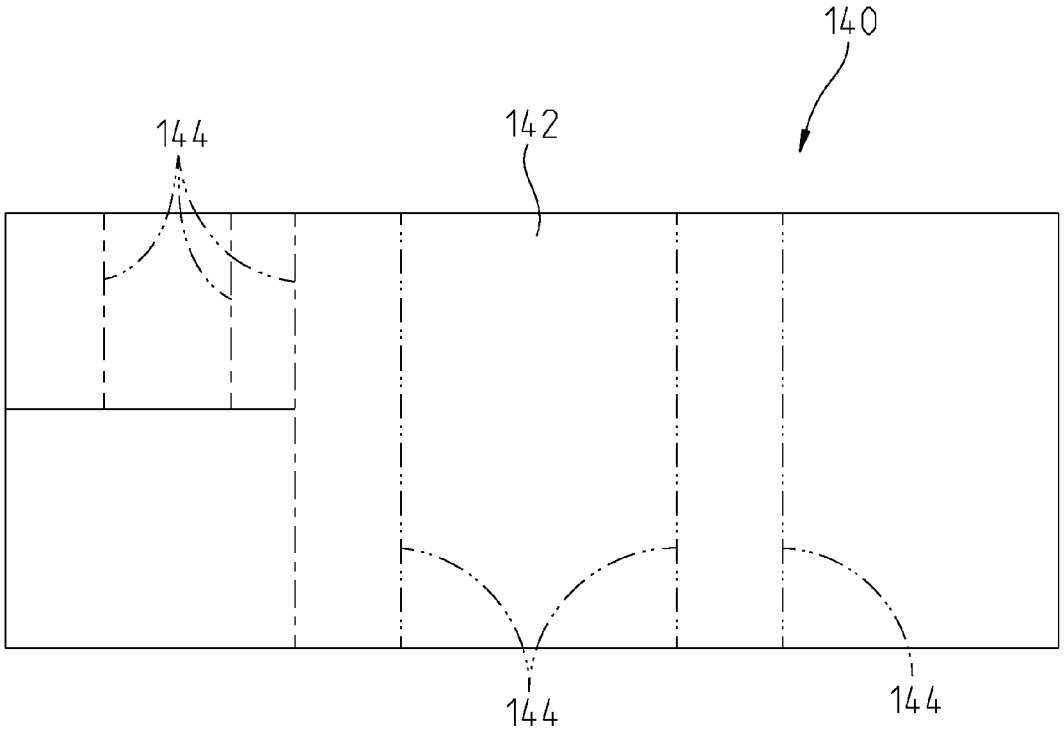
FIG. 23A is a plan view of an unfolded cardboard blank used in making the tank lid fitment of FIG. 11.

Referring now to FIGS. 5 and 19-21, an illustrative tank package 60 receives the toilet tank 14 and includes a tank top fitment 62 (FIG. 19), a tank base fitment 64 (FIG. 20), and a tank outlet fitment 66 (FIGS. 21A and 21B). The tank top fitment 62 is illustratively formed from a corrugated cardboard blank 68. The cardboard blank 68 is folded along score or fold lines 70 to define the tank top fitment 62 for receiving and protecting an upper portion 72 of the toilet tank 14 (having an open end which supports the tank lid 16). Tabs 71 may be received within slots 73 to secure the cardboard blank 68 in its folded configuration. As discussed herein, the toilet tank 14 is inverted in the carton 18 such that the relatively wide upper portion 72 of the tank 14 is supported adjacent the bottom wall 26 of the carton 18.

Figure 5:
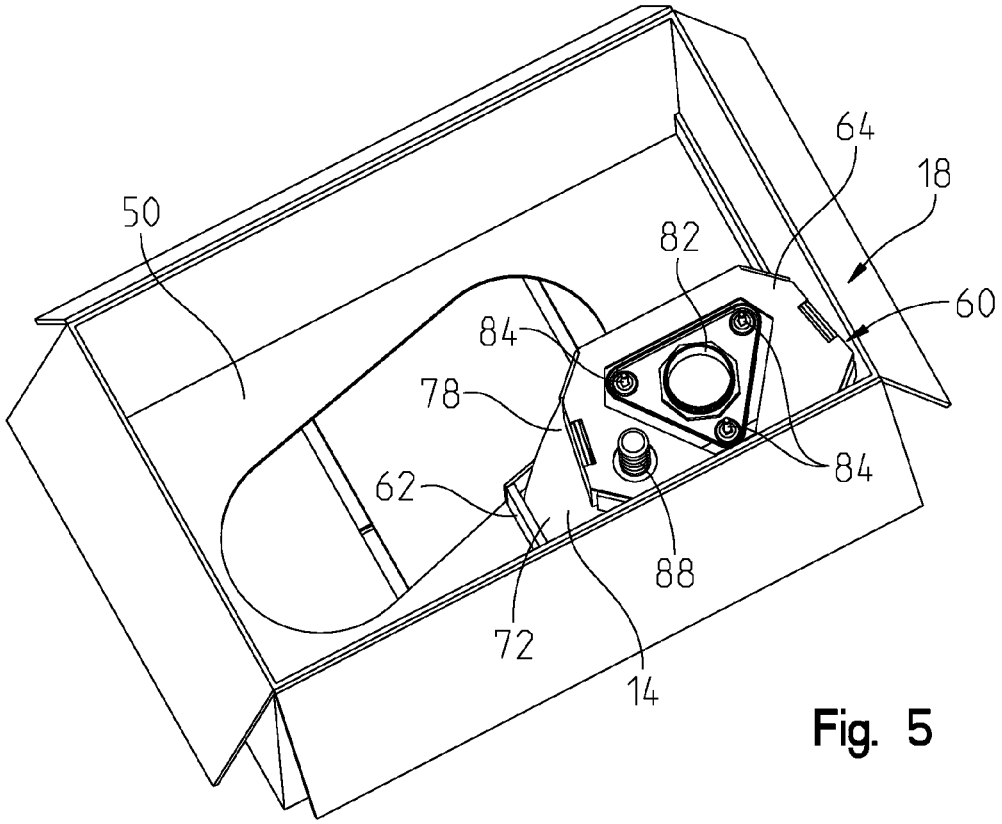
FIG. 5 is a perspective view showing a toilet tank placed within the carton of FIG. 4.

With further reference to FIGS. 5 and 20, the tank base fitment 64 is illustratively formed from a corrugated cardboard blank 74. The cardboard blank 74 is folded along score or fold lines 76 to define the tank base fitment 64 for receiving and protecting a lower portion or base 78 of the toilet tank 14. Tabs 77 may be received within slots 79 to secure the cardboard blank 74 in its folded configuration. A first opening 80 within the fitment 64 is configured to receive the lower outlet 82 of the tank 14 and the mounting bolts or studs 84 of the toilet tank 14 (FIG. 5). A second opening 86 is configured to receive an inlet 88 of the tank 14.

With reference to FIGS. 21A and 21B, the tank outlet fitment 66 illustratively comprises a cylindrical cardboard tube 89 positioned over the outlet 82 and within the opening 80 of the tank base fitment 64.

Figure 6:
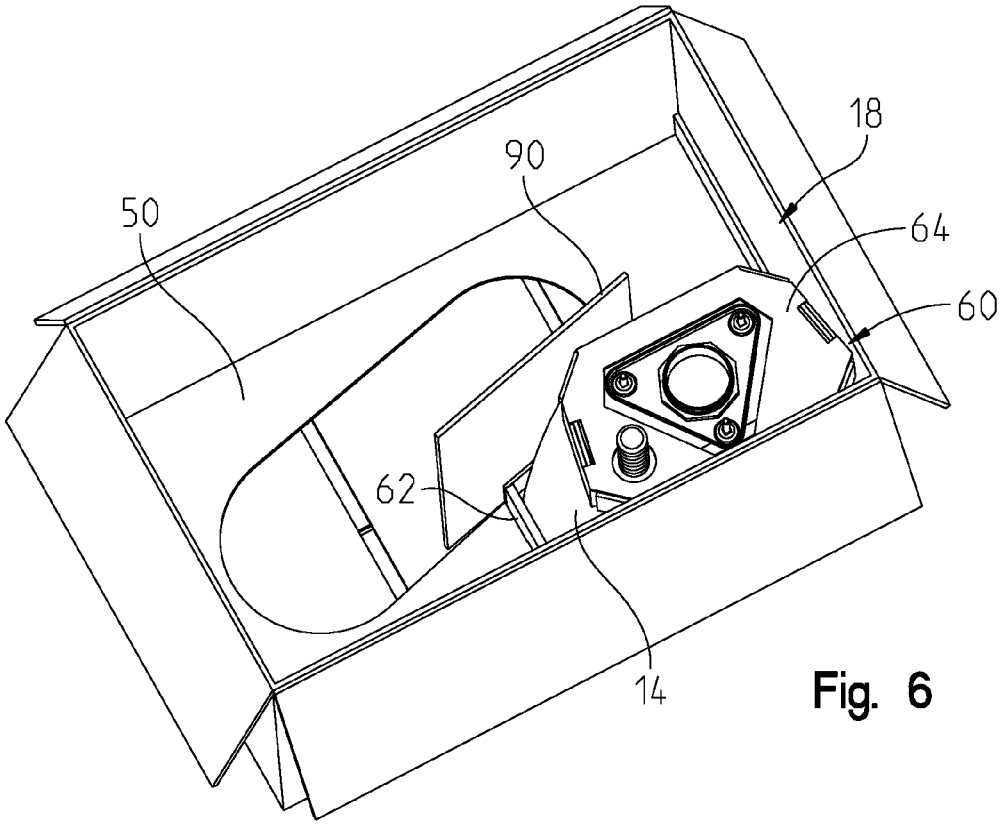
FIG. 6 is a perspective view showing a bowl/tank separator placed adjacent the tank of FIG. 5.

As shown in FIGS. 6 and 17, a bowl/tank separator or tank protective member 90 is placed adjacent a side wall of the tank 14. The separator 90 is illustratively formed of corrugated cardboard and protects the toilet tank 14 from contacting the toilet bowl 12. Illustratively, the bowl/tank separator 90 is of the same configuration as the tank base pad 46.

Figure 7:
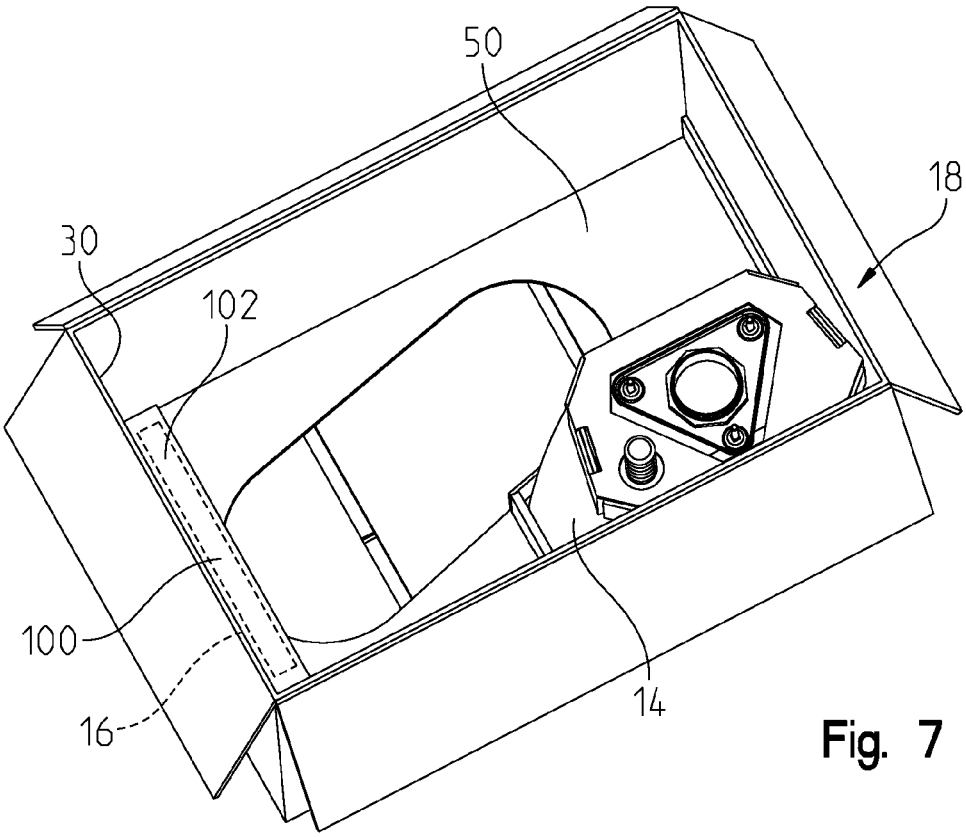
FIG. 7 is a perspective view showing a tank lid pack placed within the carton FIG. 6.

With reference to FIG. 7, a tank lid pack 100 receives the tank lid 16 and is positioned adjacent the front end wall 30 of the carton 18. The tank lid pack 100 is illustratively formed of a folded cardboard blank 102, sized and shaped form a carton enclosing the tank lid 16.

Figure 8:
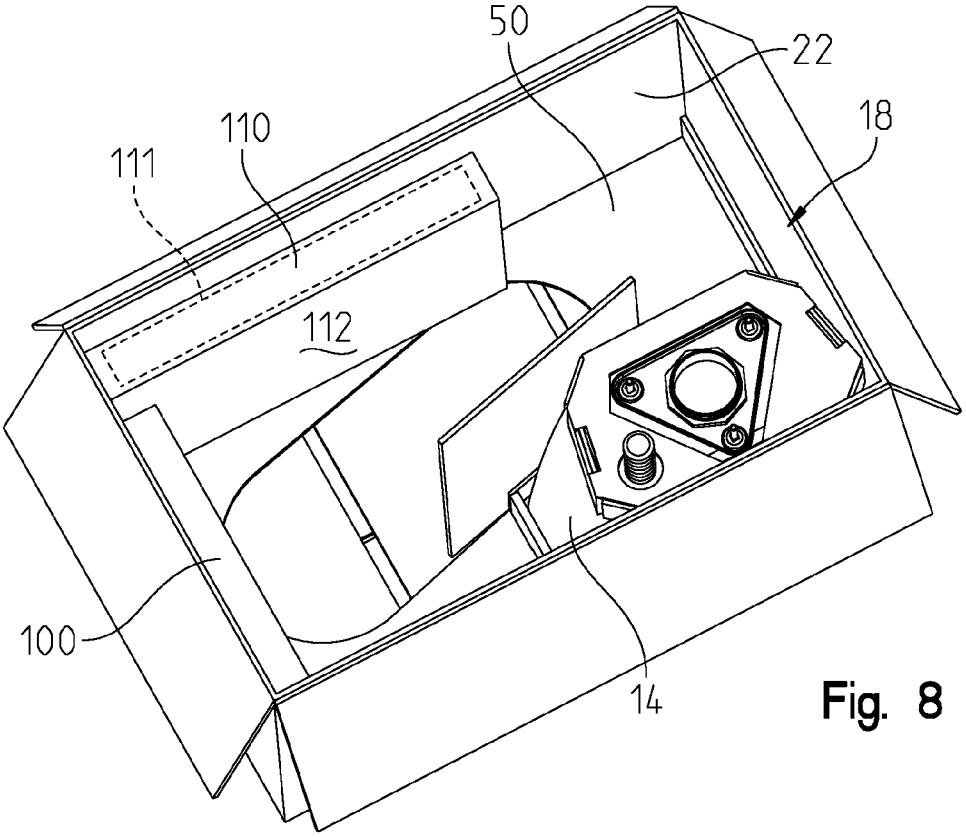
FIG. 8 is a perspective view showing a toilet seat pack placed within the carton of FIG. 7.
Figure 9:
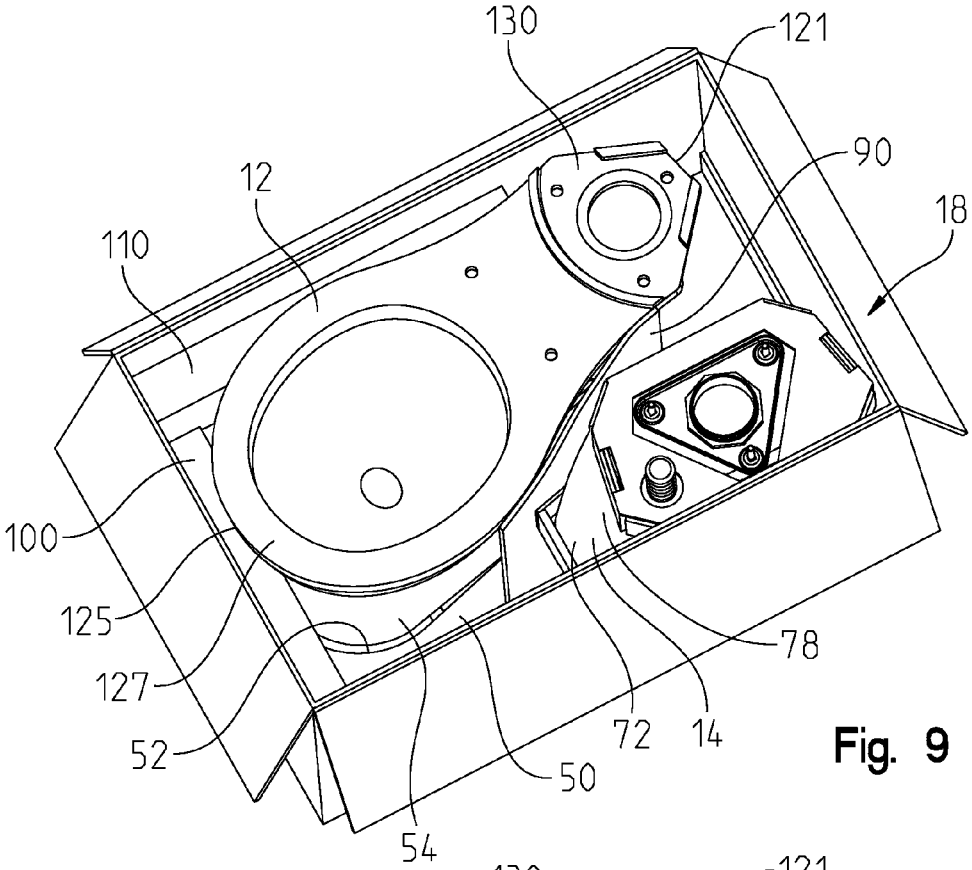
FIG. 9 is a perspective view showing a toilet bowl placed within the carton of FIG. 8.
Figure 10:
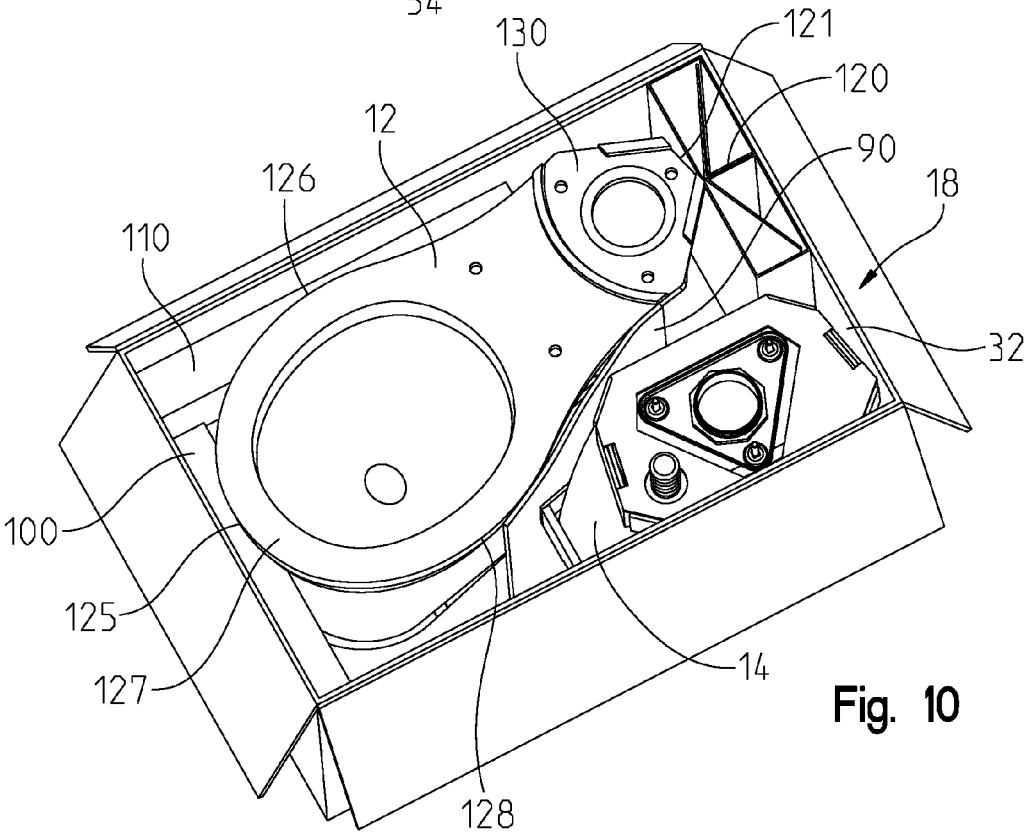
FIG. 10 is a perspective view showing a toilet end fitment placed within the carton of FIG. 9.
Figure 11:
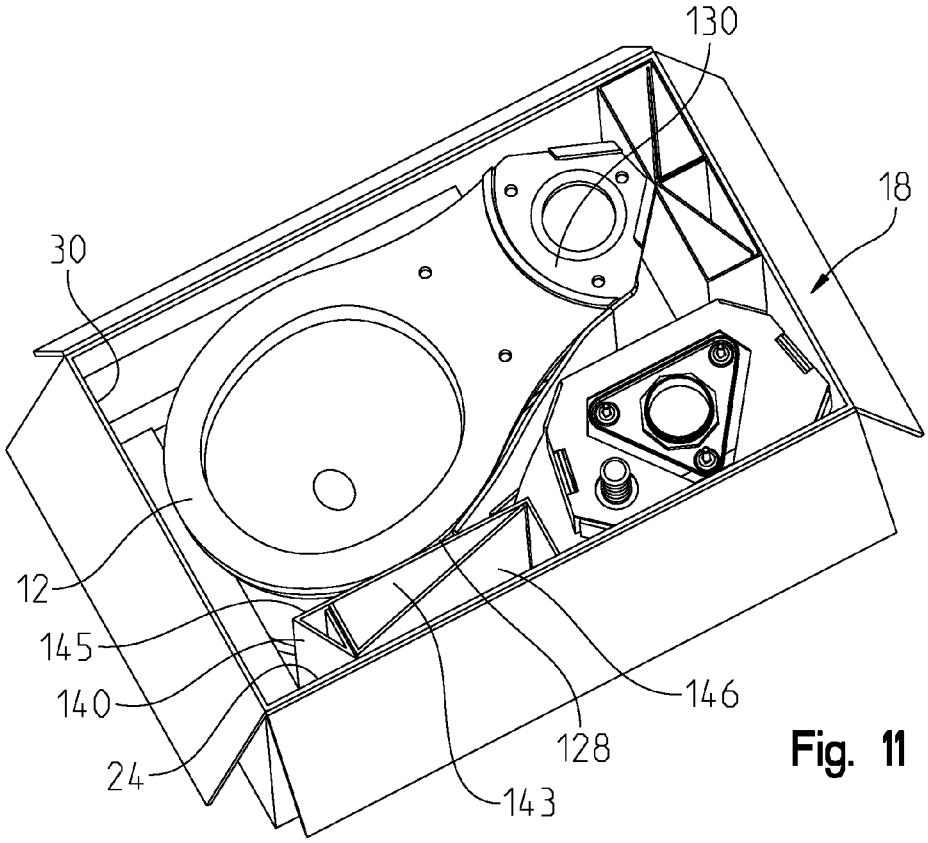
FIG. 11 is a perspective view showing a tank lid fitment placed within the carton of FIG. 10.
Figure 12:
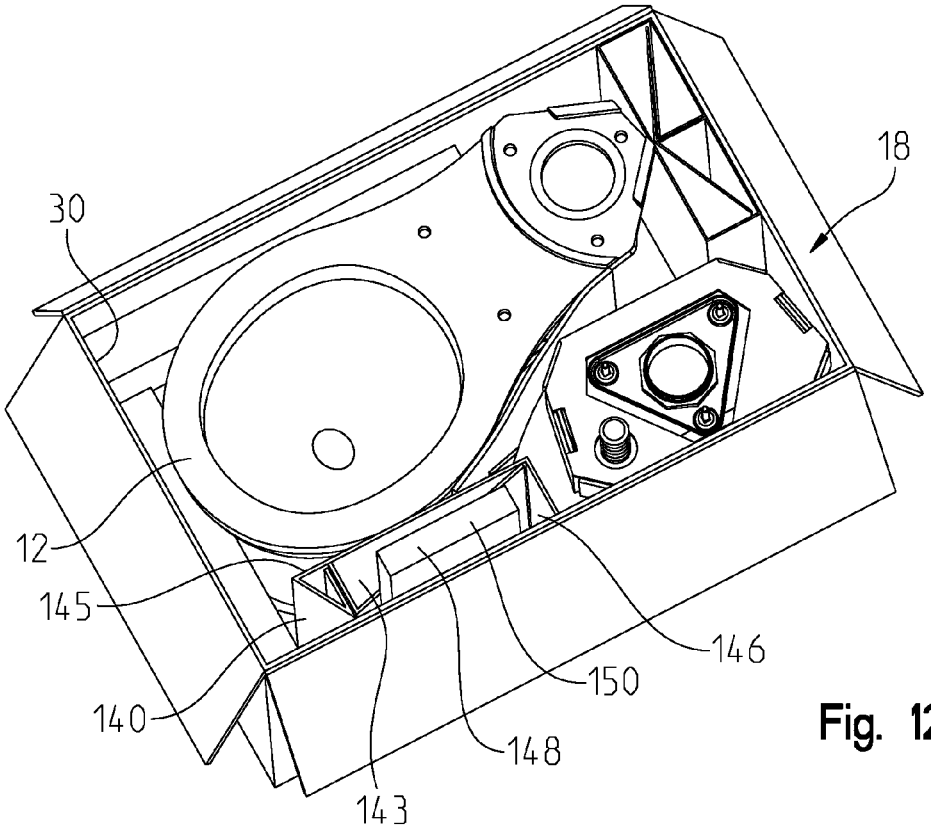
FIG. 12 is a perspective view showing an accessory pack placed within the tank lid fitment of FIG. 11.

Referring now to FIG. 8, a toilet seat pack 110 receives a conventional toilet seat 111 and is positioned adjacent the first side wall 22 of the carton 18 above the location fitment 50. More particularly, the toilet seat pack 110 is illustratively wedged (i.e., friction fit) between the first side wall 22 and an end of the toilet lid pack 100, thereby helping secure these packs 100 and 110 within the outer carton 18. The toilet seat pack 110 is illustratively formed of a folded cardboard blank 112, sized and shaped to receive conventional toilet seat 111 configured to be assembled to the toilet bowl 12.

With reference to FIGS. 9, 10, 22A and 22B, a toilet end fitment 120 is positioned intermediate a rear end 121 of the toilet bowl 12, defined by a tank mounting portion or shelf 130, and the rear end wall 32 of the carton 18. The toilet end fitment 120 is illustratively formed of a corrugated cardboard blank 122. The cardboard blank 122 is folded along score or fold lines 124 to define the toilet end fitment 120 for securing and protecting the toilet bowl 12.

As detailed herein, the base or foot 54 of the toilet bowl 12 is properly located within the carton 18 by being received within the opening 52 of the location fitment 50. A front end 125 of the toilet bowl 12, illustratively defined by the toilet bowl rim 127, is positioned adjacent to and illustratively contacts the tank lid pack 100. A first side 126 of the toilet bowl 12 is positioned adjacent to and illustratively contacts the toilet seat pack 110. A second side 128 of the toilet bowl 12, near rear tank mounting shelf 130, is positioned adjacent the tank 14. As noted above, bowl/tank separator 90 is positioned between the bowl 12 and the tank 14. Due to the inverted placement of the tank 14 relative to the bowl 12, a nested arrangement is possible. More particularly, the wider upper portion 72 of the tank 14 is positioned adjacent the narrow lower mounting portion or base 54 of the bowl 12, while the narrower lower portion 78 of the tank 14 is positioned above the upper portion 72 and adjacent the wider rim 127 and mounting shelf 130 of the bowl 12.

Referring now to FIGS. 11, 12 and 23A-23C, a tank lid fitment 140 is positioned intermediate the second side 128 of the toilet bowl 12 and the second side wall 24 of the carton 18. The tank lid fitment 140 is illustratively formed of a corrugated cardboard blank 142. The cardboard blank 142 is folded along score or fold lines 144 to define the tank lid fitment 140 for securing and protecting the toilet bowl 12. The tank lid fitment 140 illustratively includes a main rectangular body 143 and a triangular extension 145. The extension 145 may contact the tank lid pack 100. The body 143 defines a chamber 146 to receive an accessory pack 148 for the packaged toilet. The accessory pack 148 may include a box 150 containing mounting hardware, installation instructions, etc.

Figure 13:
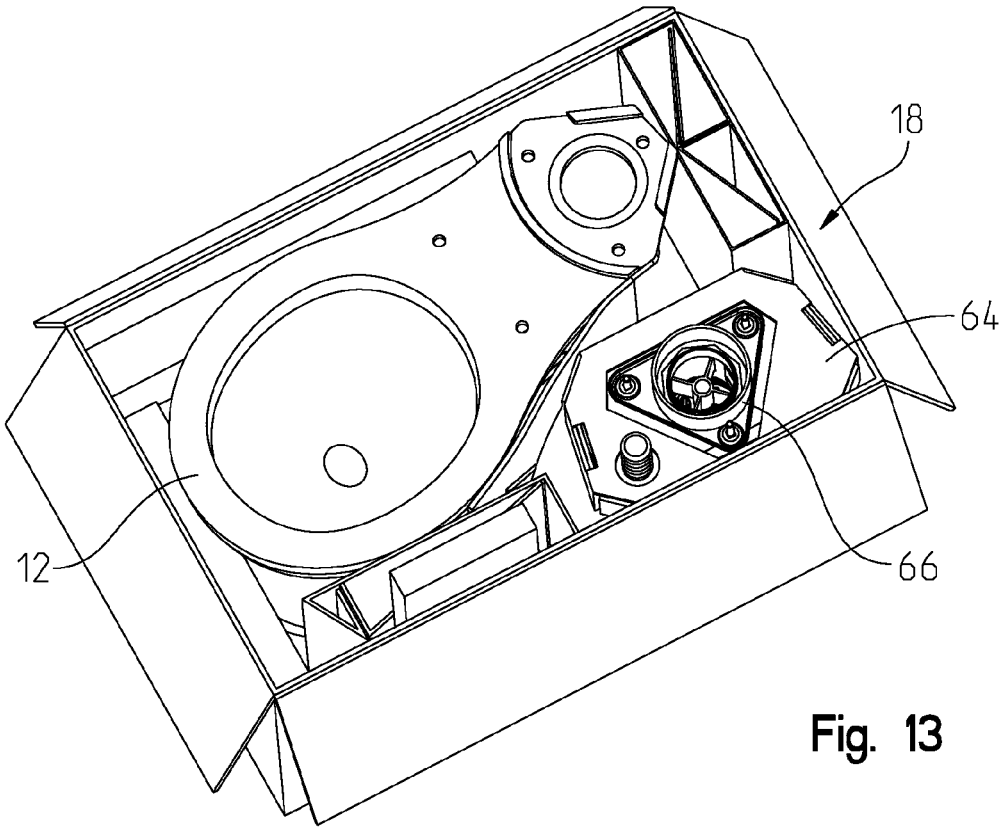
FIG. 13 is a perspective view showing a tank outlet tube placed on the toilet tank of FIG. 12.
Figure 14:
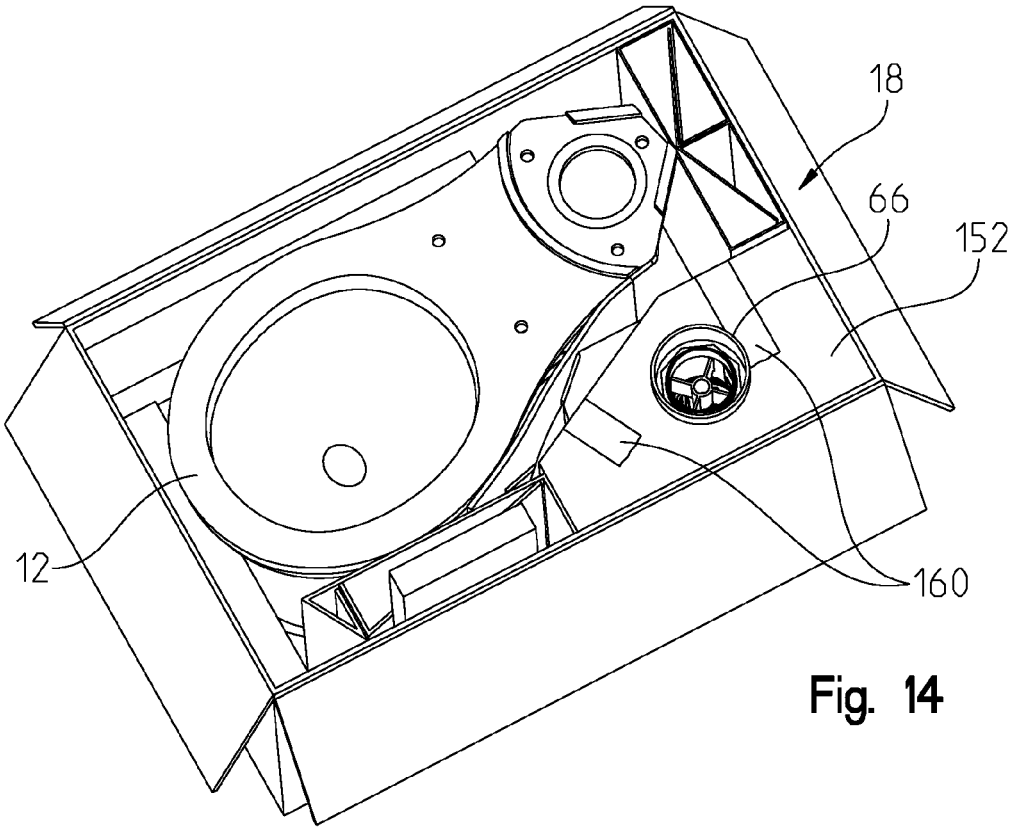
FIG. 14 is a perspective view showing the tank outlet tube fitment placed over the tank outlet tube of FIG. 13.
Figure 24:
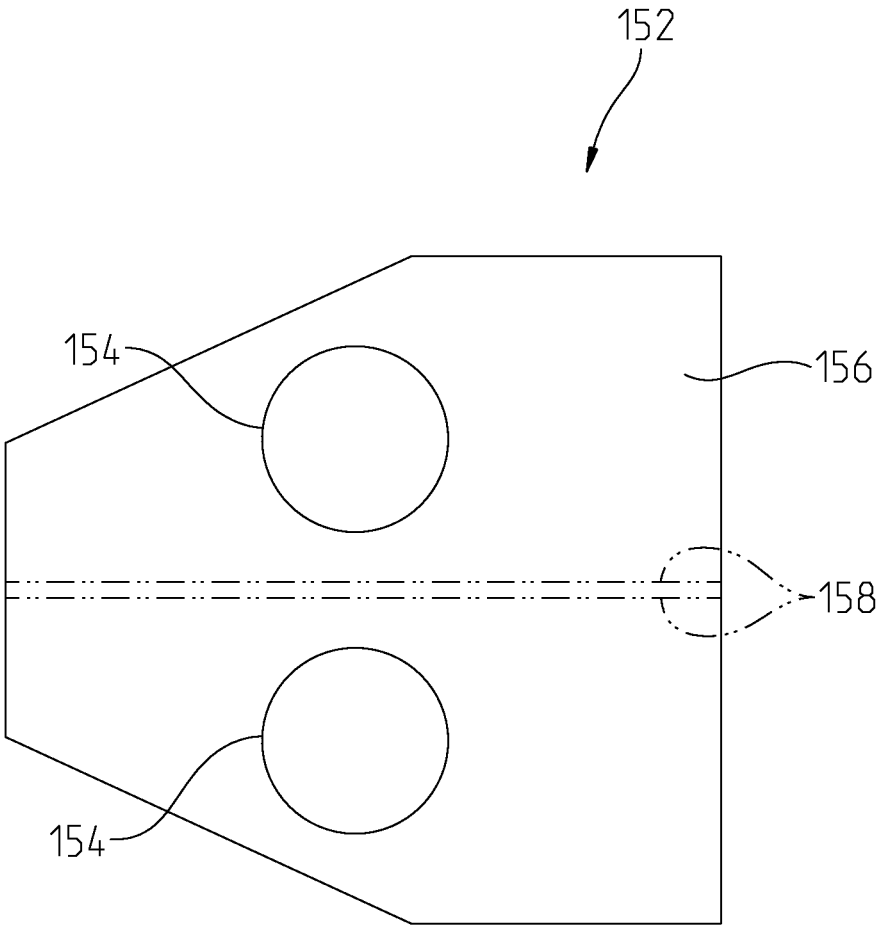
FIG. 24 is a plan view of an unfolded cardboard blank used in making the tank outlet tube fitment of FIG. 14.

With reference to FIGS. 13, 14 and 24, a tank or small top fitment 152 is received above the tank base fitment 64. The tank top fitment 152 includes an opening 154 receiving the tank outlet fitment 66. The tank top fitment 152 is illustratively formed of a corrugated cardboard blank 156. The cardboard blank 156 is folded along score or fold lines 158 to define the tank top fitment 152 and may be secured in place on the tank base fitment 64 with conventional means, such as adhesive tape 160.

Figure 15:
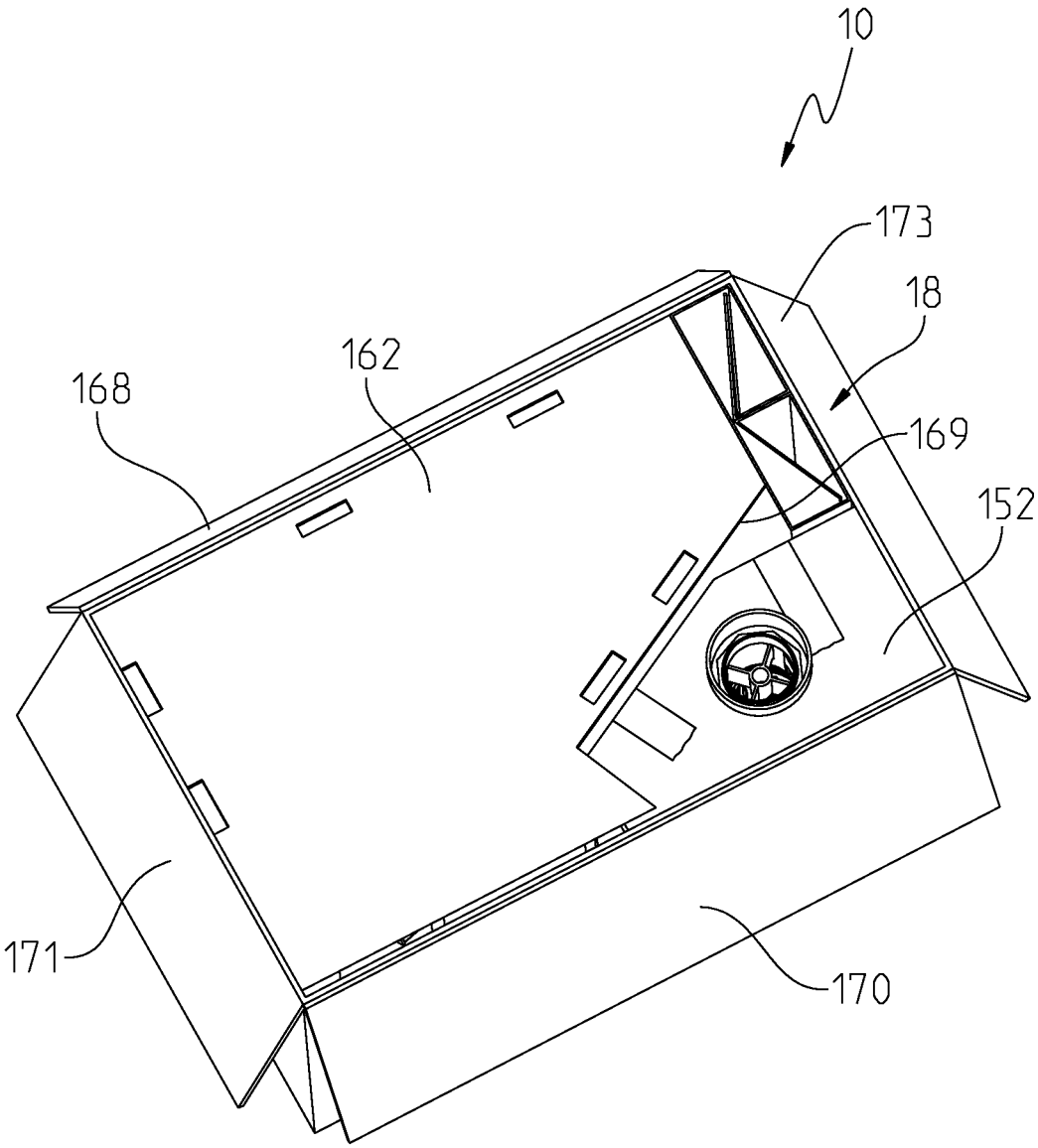
FIG. 15 is a perspective view showing the bowl top fitment placed over the toilet bowl of FIG. 14.
Figure 25:
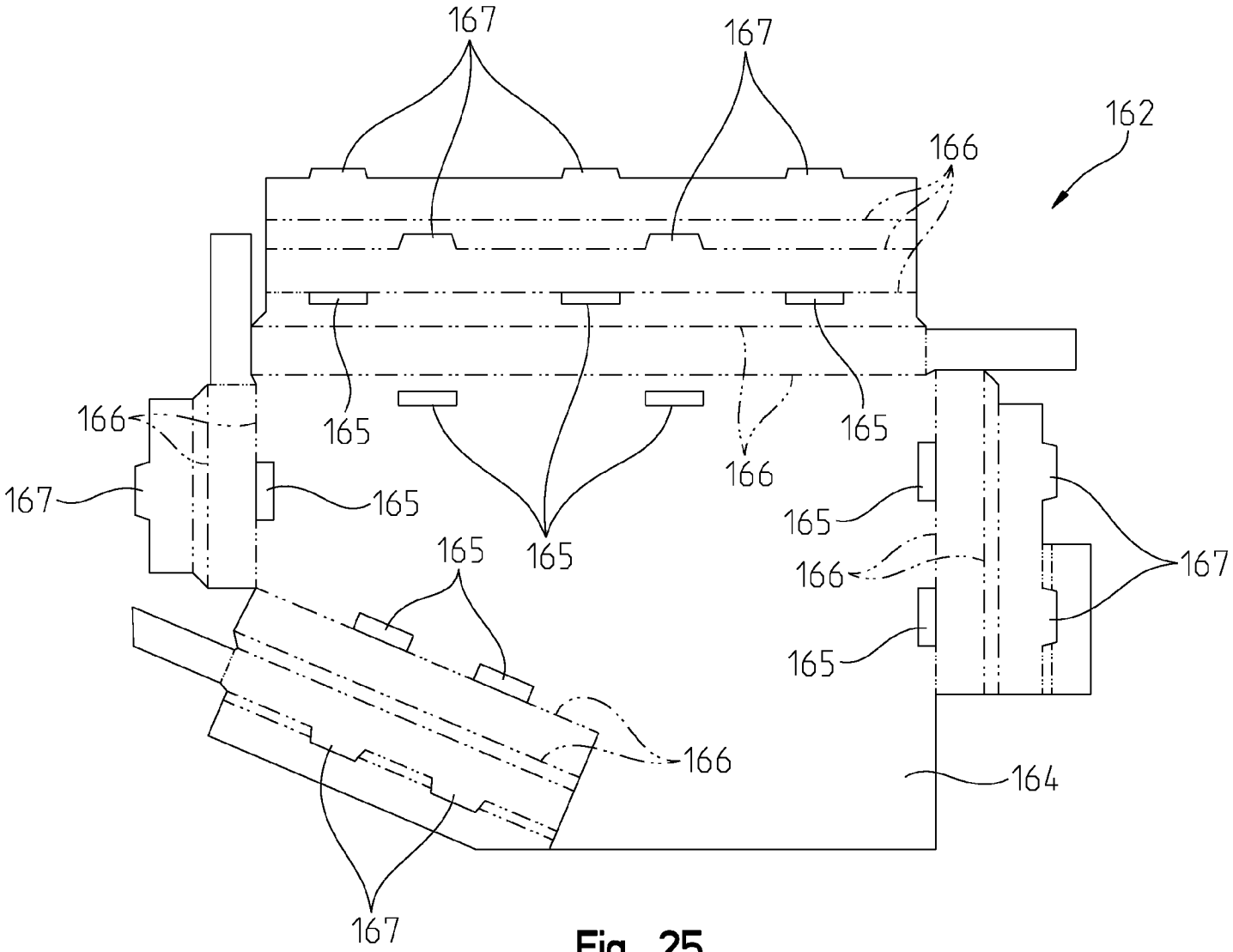
FIG. 25 is a plan view of an unfolded cardboard blank used in making the bowl top fitment of FIG. 15.

As shown in FIGS. 15 and 25, a bowl or large top fitment 162 is placed above the toilet bowl 12. The bowl top fitment 162 is illustratively formed of a corrugated cardboard blank 164. The cardboard blank 164 is folded along score or fold lines 166 to define the bowl top fitment 162. Slots 165 may be formed within the blank 164 to receive locking tabs 167. The bowl top fitment 162 illustratively defines a notch or recess 169 for receiving the tank fitments 64 and 152.

Upper flaps 168, 170, 171 and 173 of the carton 18 are folded to close the upper opening above the fitments 152 and 162. Flaps 168 and 170 may be secured in place through conventional means, such as adhesive tape (not shown) to complete the packaging system 10.

Figure 26:
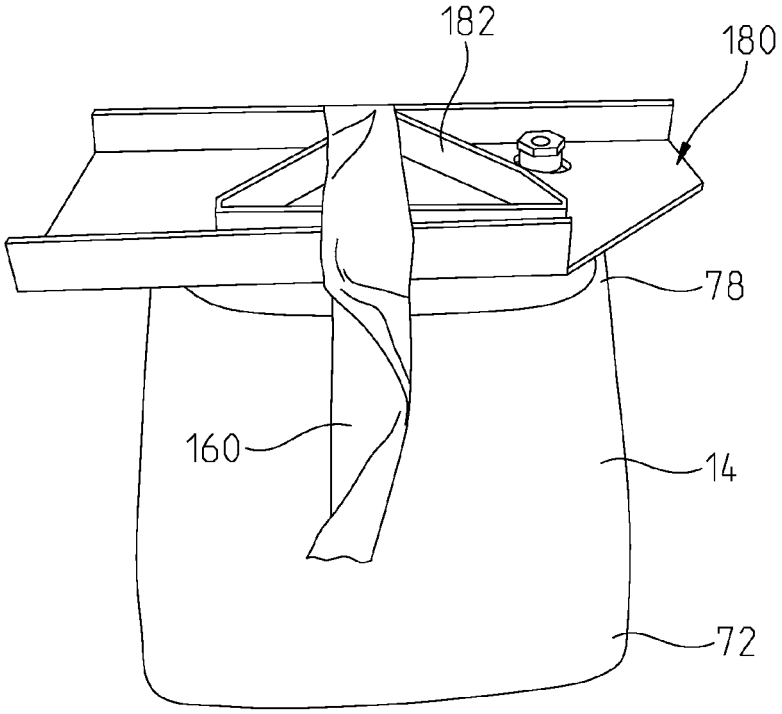
FIG. 26 is a perspective view of a further illustrative tank base fitment and tank spacer supported on a toilet tank.
Figure 27:
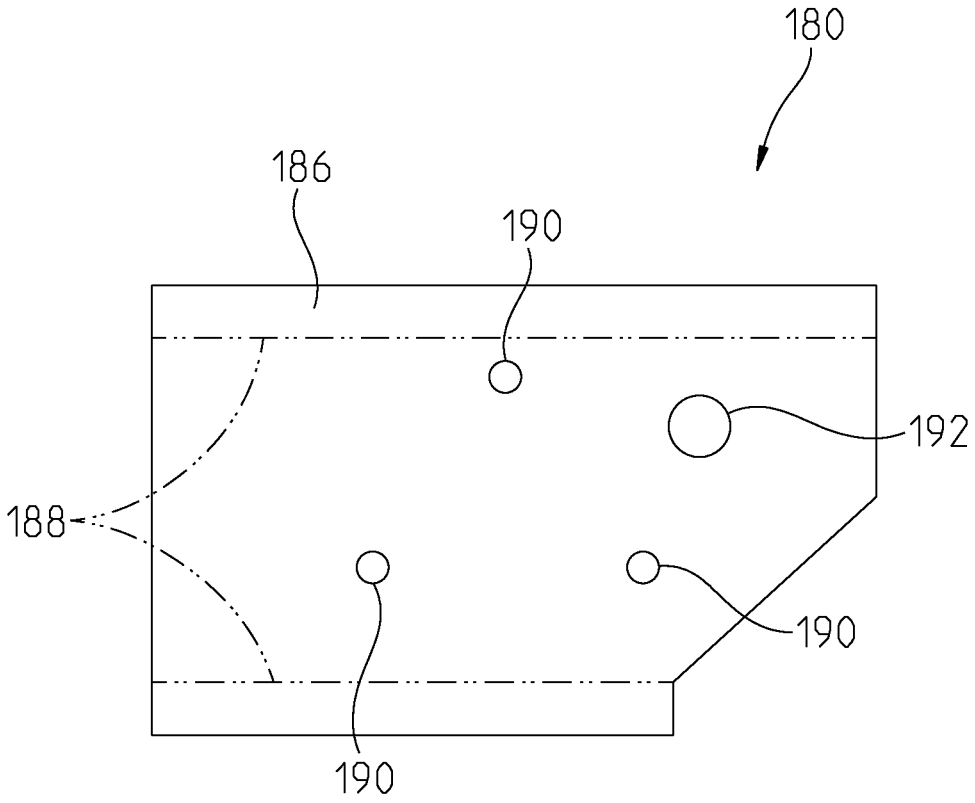
FIG. 27 is a plan view of an unfolded cardboard blank used in making the illustrative tank top fitment of FIG. 26.
Figure 28:
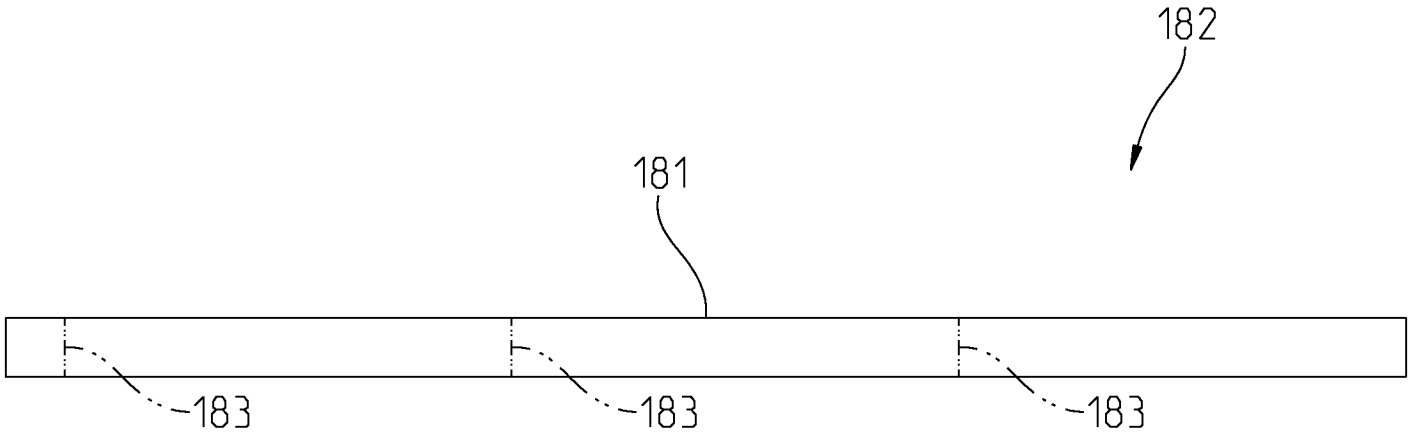
FIG. 28 is a plan view of an unfolded cardboard blank used in making the tank spacer of FIG. 26.
Figure 30:
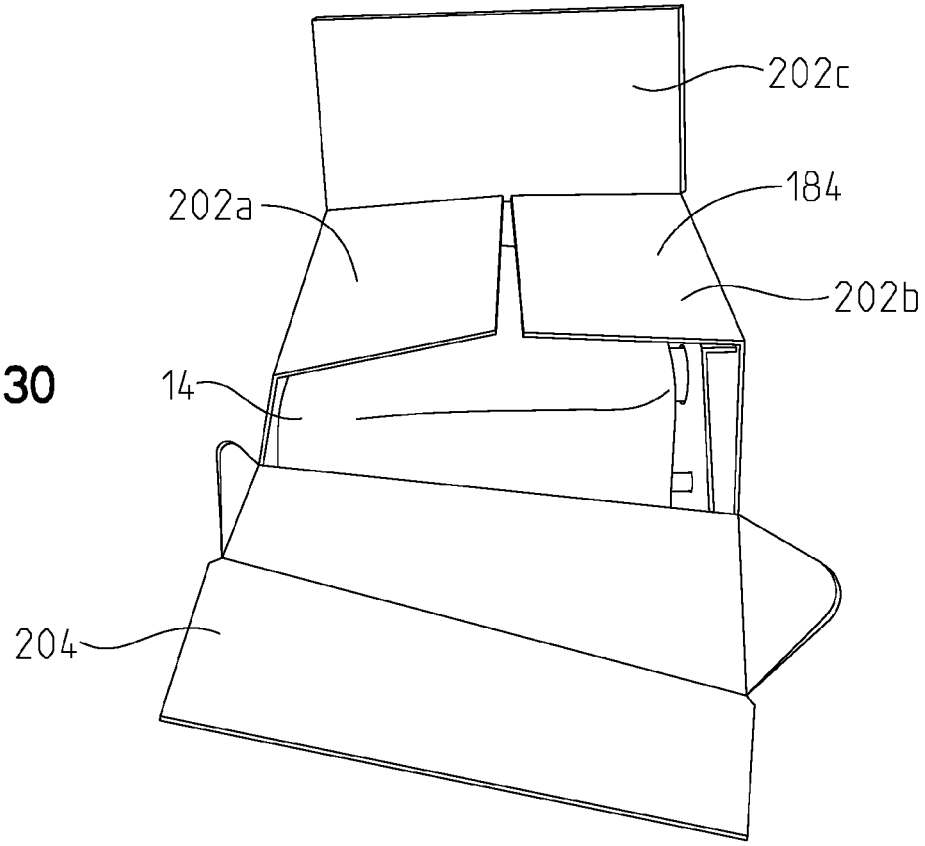
FIG. 30 is a perspective view of the tank carton of FIG. 29 with the side flaps closed.
Figure 31:
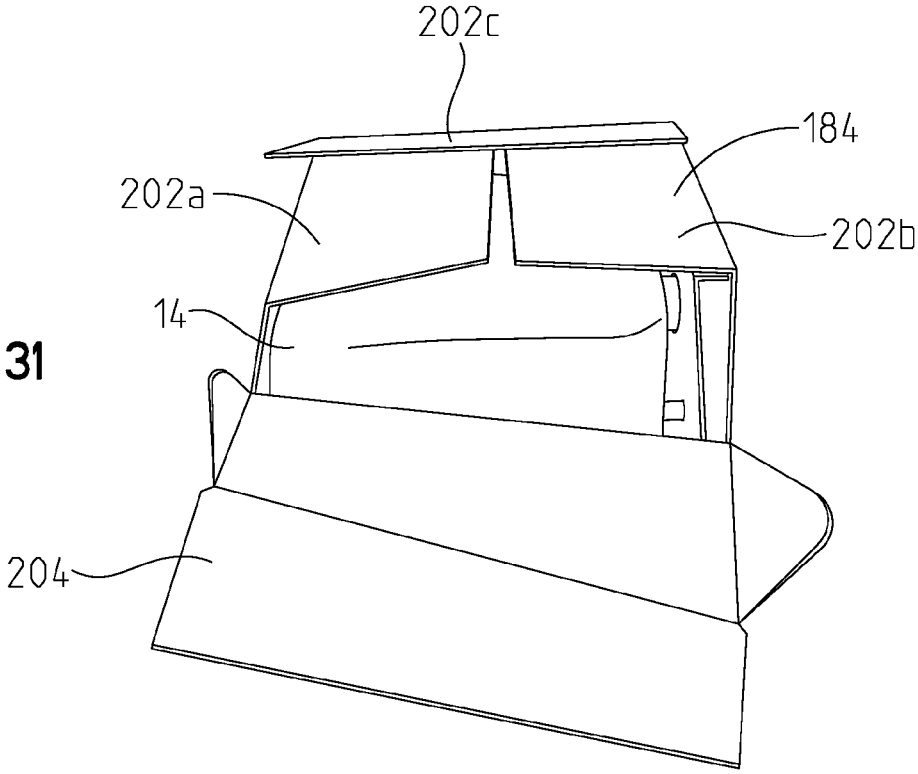
FIG. 31 is a perspective view of the tank carton of FIG. 30 with the top flap closed.
Figure 32:
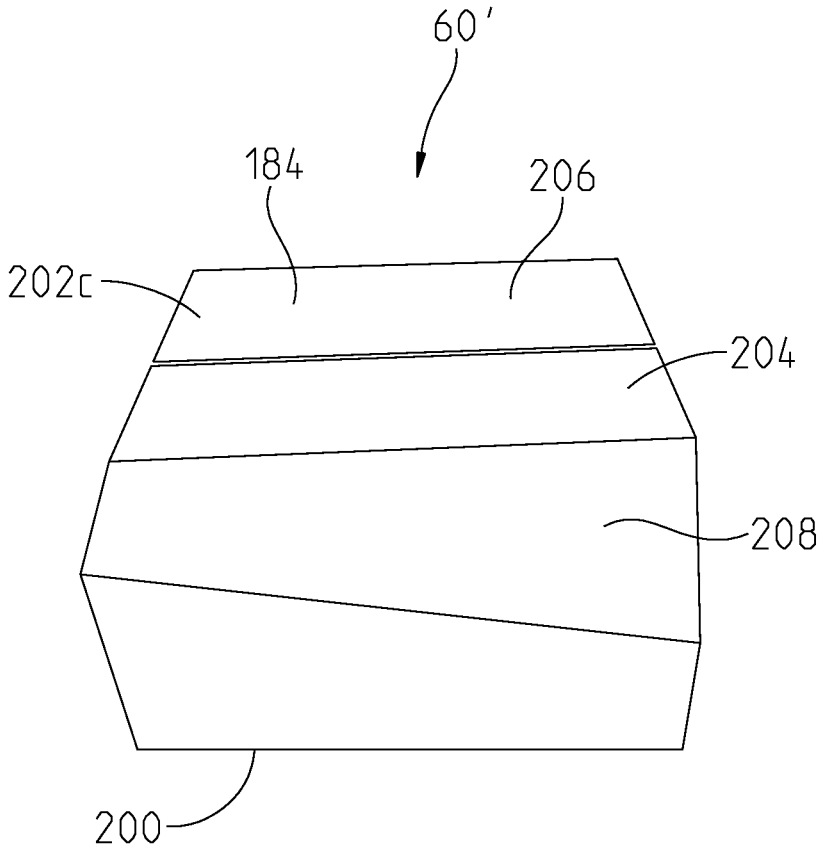
FIG. 32 is a perspective view of the assembled tank carton of FIG. 31.

With reference to FIGS. 26-28, in an alternative embodiment packaging system, the tank outlet fitment 66 and the first top fitment 152 may be replaced with a tank base fitment 180 and a tank spacer fitment 182. As shown in FIGS. 26 and 27, the tank base fitment 180 is illustratively formed from a corrugated cardboard blank 186. The cardboard blank 186 is folded along score or fold lines 188 to define the tank base fitment 180 for receiving and protecting lower portion or mounting base 78 of the toilet tank 14. The tank base fitment 180 includes a plurality of openings 190 configured to receive mounting studs 84 of the toilet tank 14. A larger opening 192 is configured to receive the tank inlet 88.

With reference to FIGS. 26 and 28, the tank outlet fitment 182 illustratively comprises a triangular shaped cardboard spacer positioned over the outlet 82 of the tank 14. The fitment 182 may be a corrugated cardboard blank 181 folded along score or fold lines 183. The tank base fitment 180 and the tank outlet fitment 182 may be secured to the tank 14 through conventional means, such as adhesive tape 160.

In a further illustrative embodiment packaging system, the tank outlet fitment 66, the first top fitment 152, the tank base fitment 64, and the tank top fitment 62 may be replaced with an alternative tank package 60' as shown in FIGS. 29-33. The tank package 60' includes the tank base fitment 180, the tank outlet fitment 182, and a tank carton 184.

Figure 29:
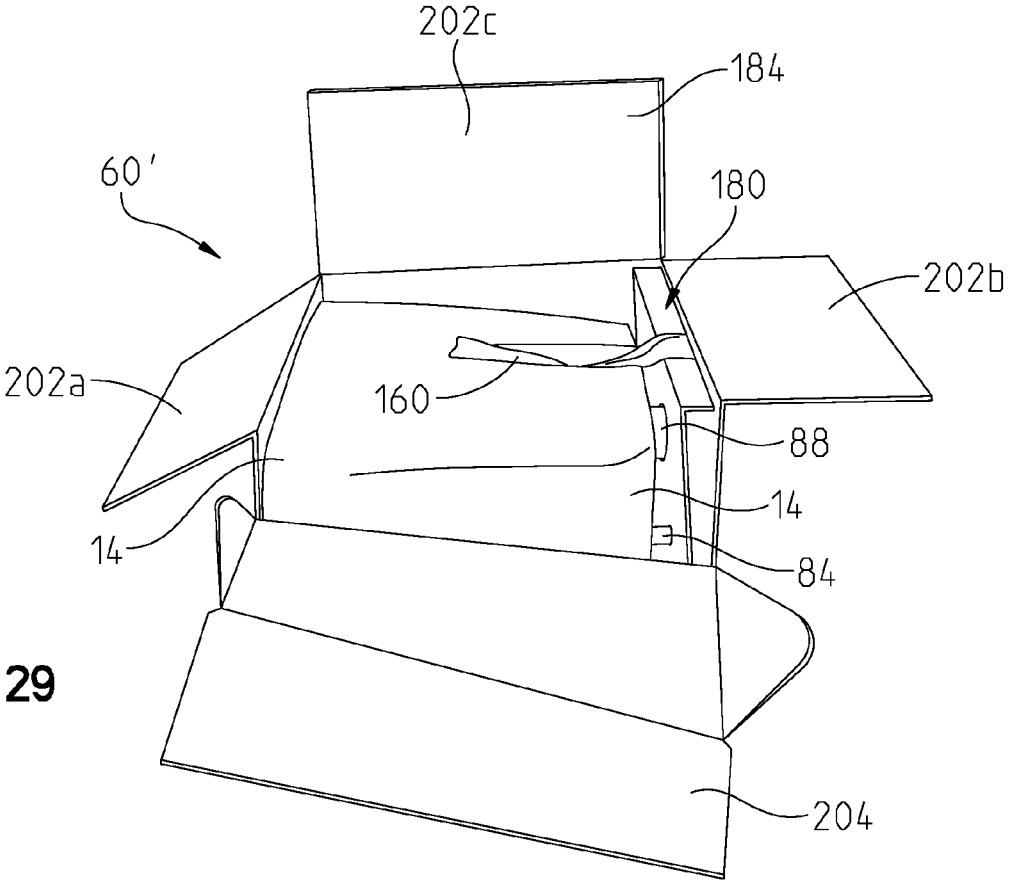
FIG. 29 is a perspective view of a toilet tank carton receiving the toilet tank of FIG. 26.
Figure 33:
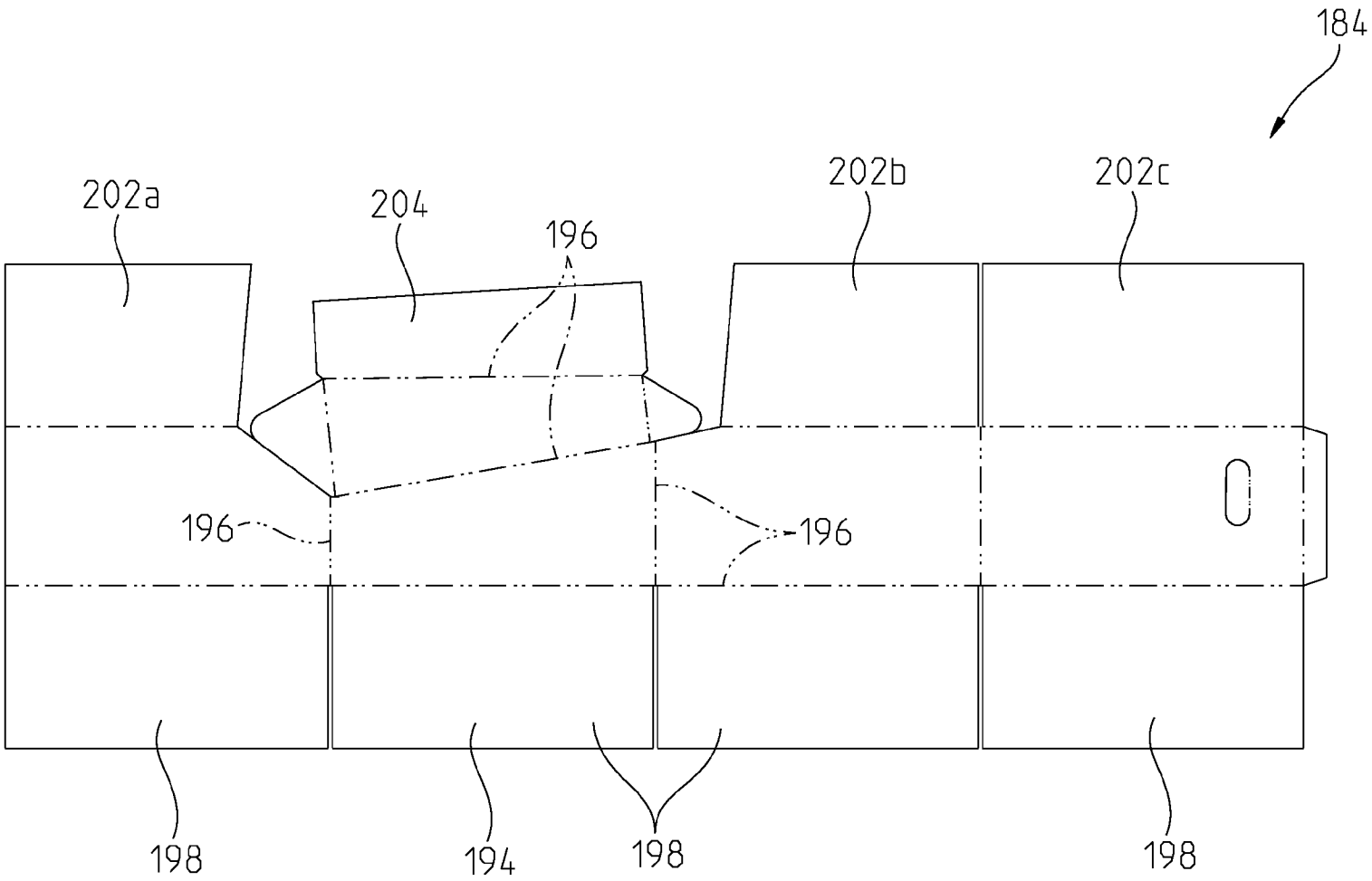
FIG. 33 is a plan view of an unfolded cardboard blank for use in making the illustrative tank carton of FIG. 29.

With reference to FIGS. 29-33, the tank carton 184 is illustratively formed from a corrugated cardboard blank 194. As shown in FIGS. 29 and 33, the cardboard blank 194 is folded along score or fold lines 196 to define the tank carton 184 for receiving and protecting the toilet tank 14. Flaps 198 cooperate with each other to form a first side wall 200, while flaps 202 and 204 cooperate with each other to form a second side wall 206. Flap 204 is angled relative to flaps 202 and defines an inclined corner 208 to accommodate the toilet bowl 12 and save space within the carton 18. The tank carton 184 may be secured to enclose the tank 14 through conventional means, such as adhesive tape.

Figure 43:
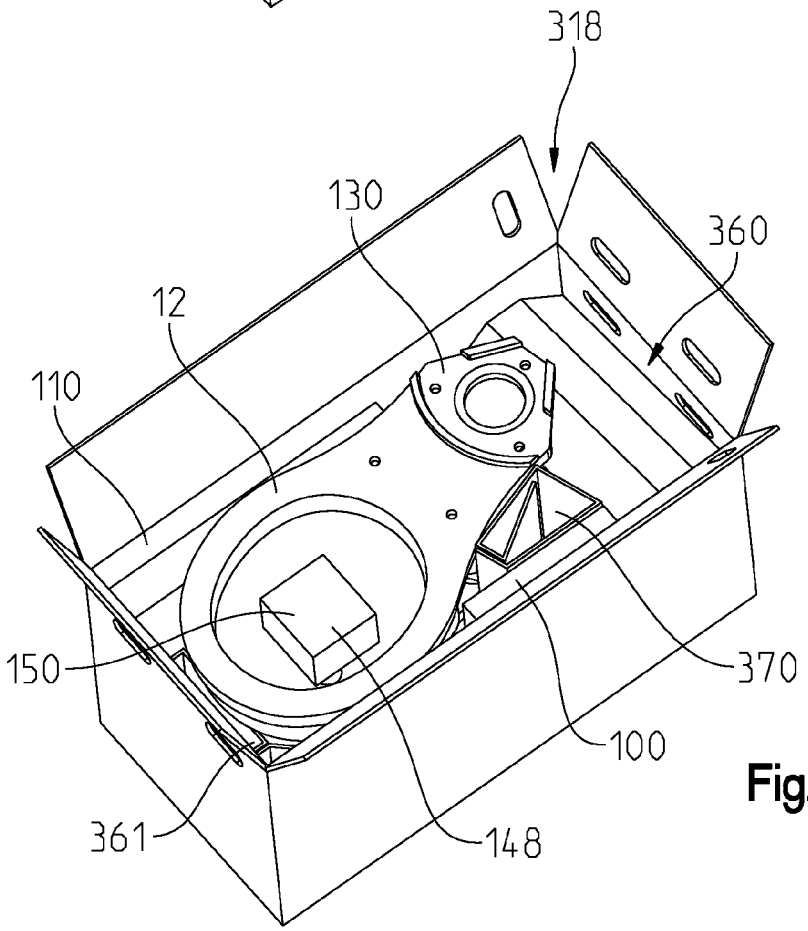
FIG. 43 is a perspective view showing an accessory pack placed within the toilet bowl of FIG. 42.
Figure 44:
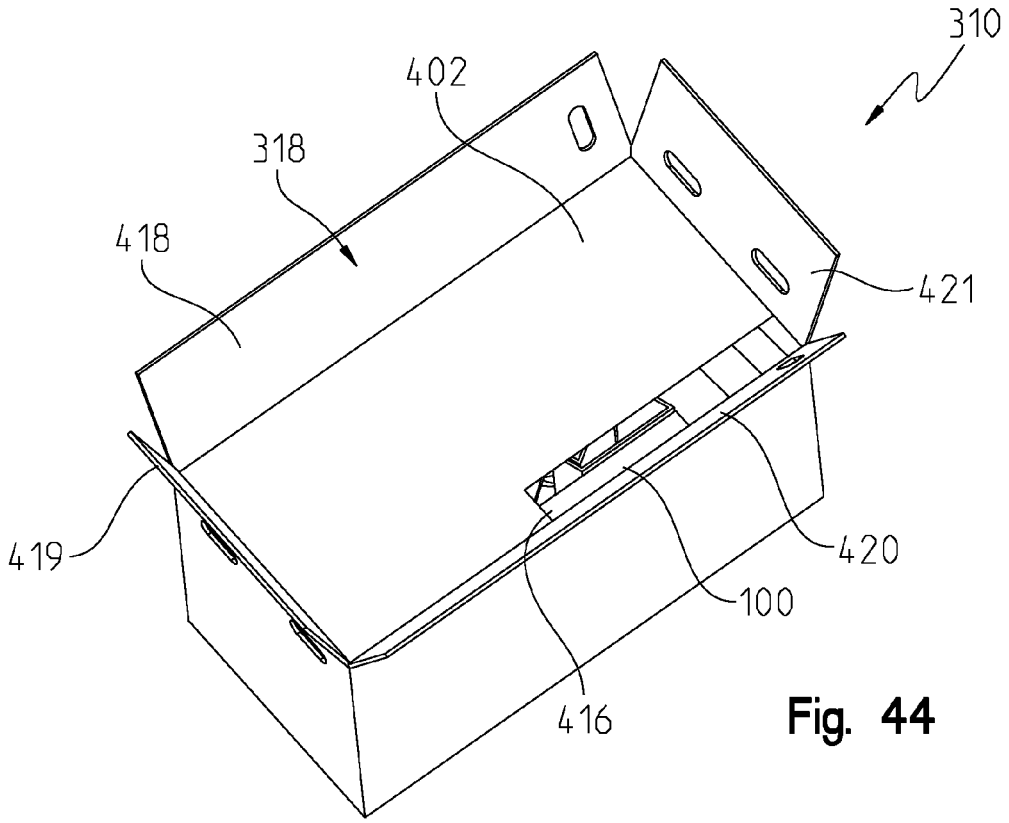
FIG. 44 is a perspective view showing the bowl top fitment placed over the toilet bowl and toilet tank of FIG. 43.
Figure 45:
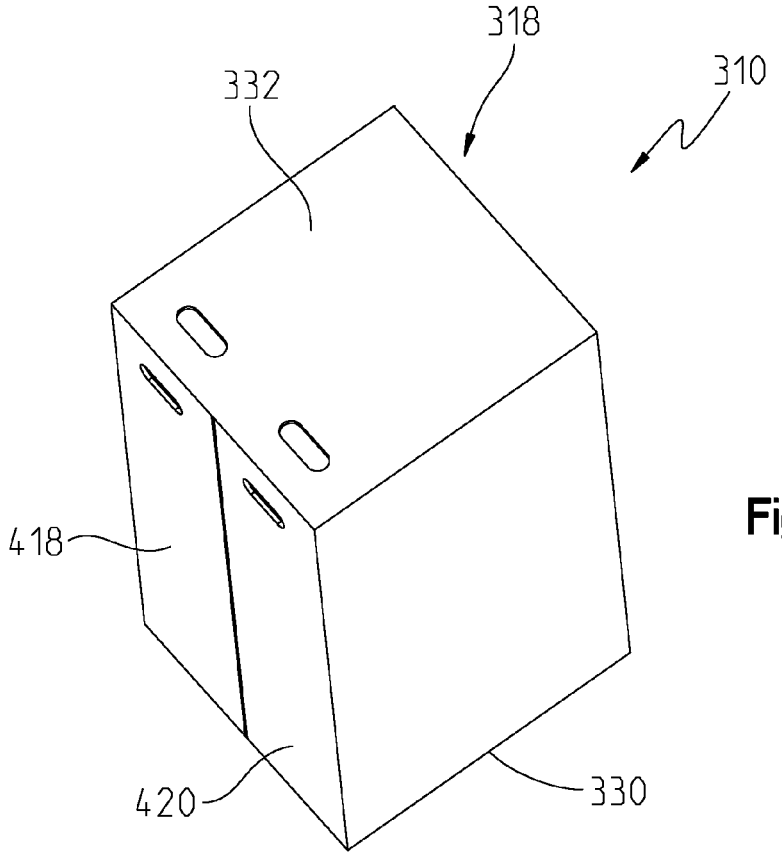
FIG. 45 is a perspective view of the completed illustrative packaging assembly with the carton supported on an end wall.

Another illustrative packaging system 310 is shown in FIGS. 34-52 for supporting a toilet storage carton 318 on an end wall 330 (FIG. 45). FIGS. 34-45 are perspective views of the packaging system 10 in various stages of assembly, while FIGS. 46-52 are various views of the cardboard components of the packaging system 310 in different unfolded and folded configurations. In FIGS. 46-52, hidden lines are used to represent score or fold lines formed within the cardboard components.

Figure 34:
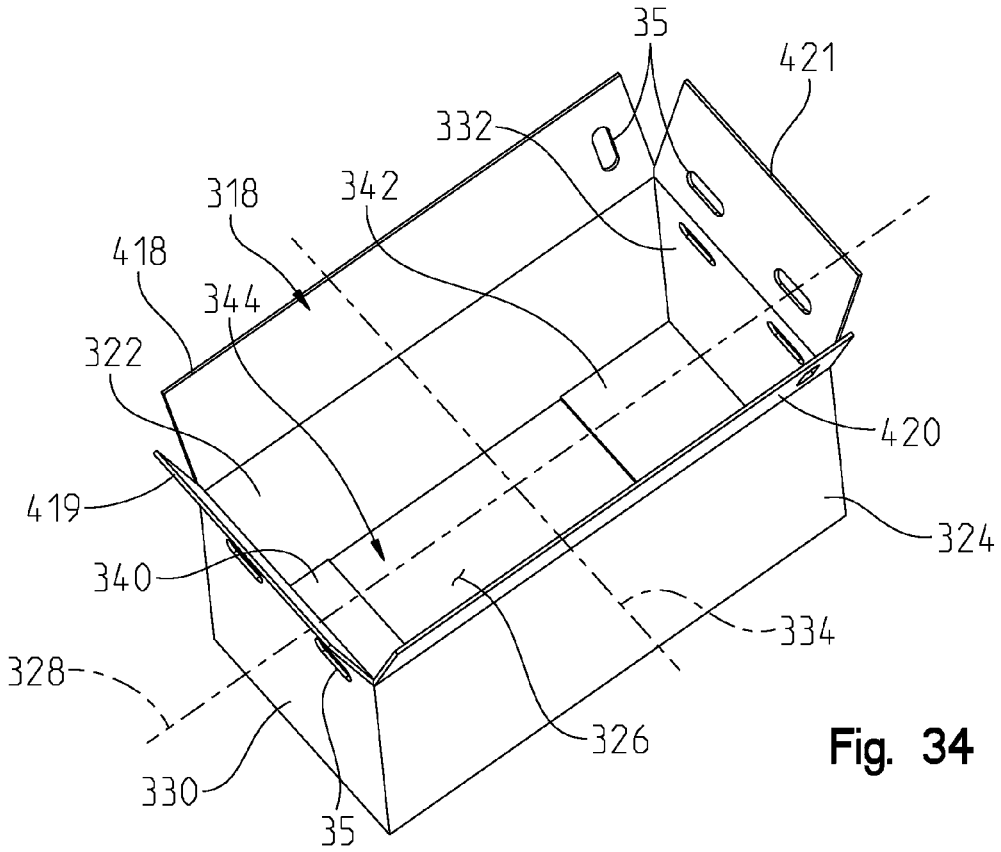
FIG. 34 is a perspective view of an empty outer carton of a further illustrative packaging system of the present disclosure.
Figure 46:
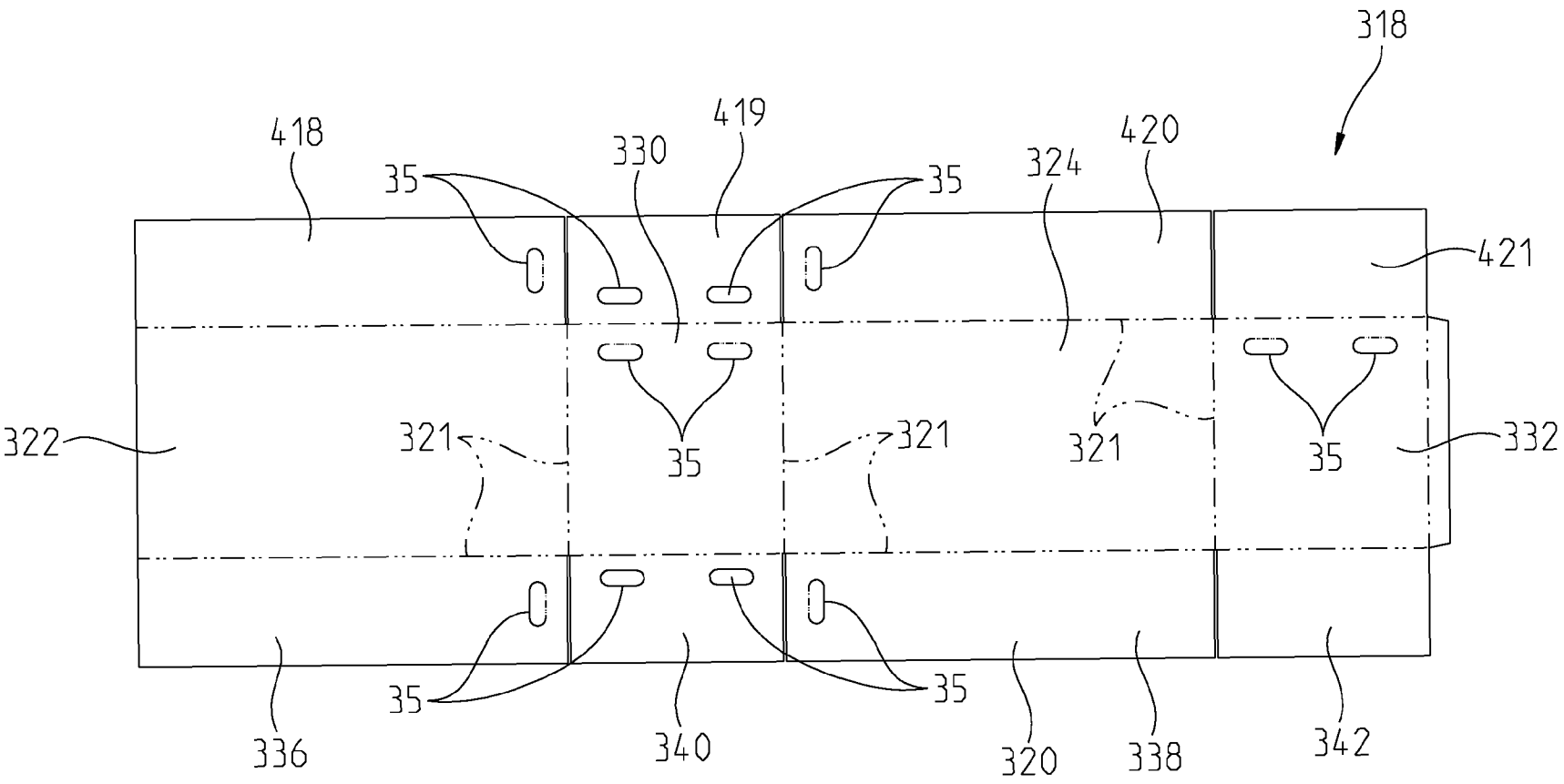
FIG. 46 is a plan view of an unfolded cardboard blank for use in making the outer carton of FIG. 34.

With reference to FIGS. 34, 45 and 46, an illustrative packaging system 310 of the present disclosure includes an outer carton 318 formed of a corrugated cardboard blank 320. When folded along score or fold lines 321, cardboard blank 320 defines carton 318 including opposing first and side walls 322 and 324 extending upwardly from a bottom wall 326. The side walls 322 and 324 illustratively extend parallel to each other and define a carton longitudinal axis 328. Opposing front and rear end walls 330 and 332 extend between the first and second side walls 322 and 324 in spaced relation to each other. The end walls 330 and 332 illustratively extend parallel to each other and define a carton lateral axis 334 extending perpendicular to the carton longitudinal axis 328. Handhold openings 35 may be formed within the end walls 330 and 332.

Figure 35:
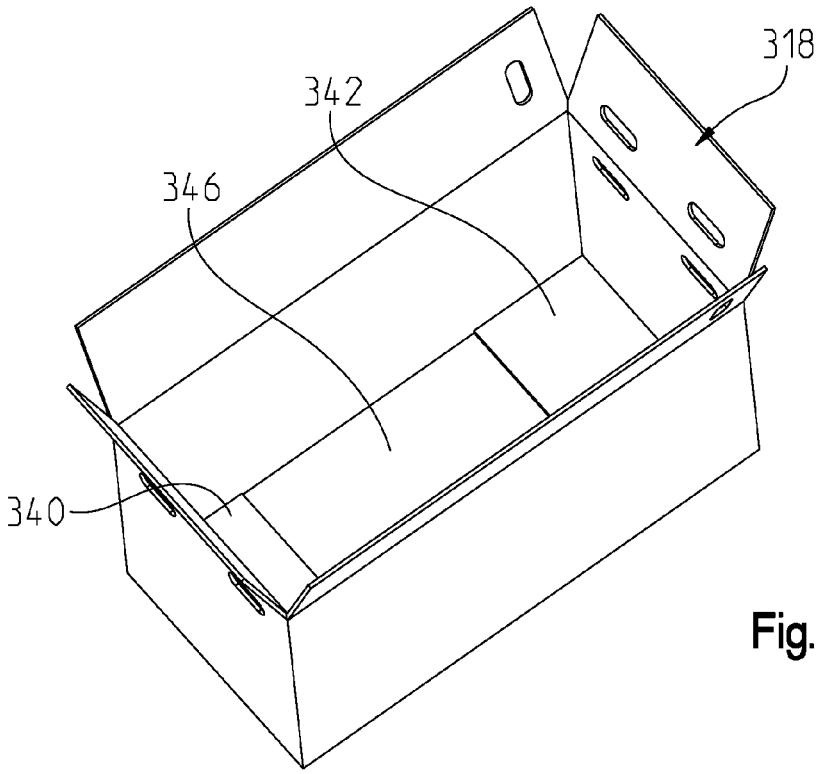
FIG. 35 is a perspective view of a base pad placed within the carton of FIG. 34.
Figure 47:
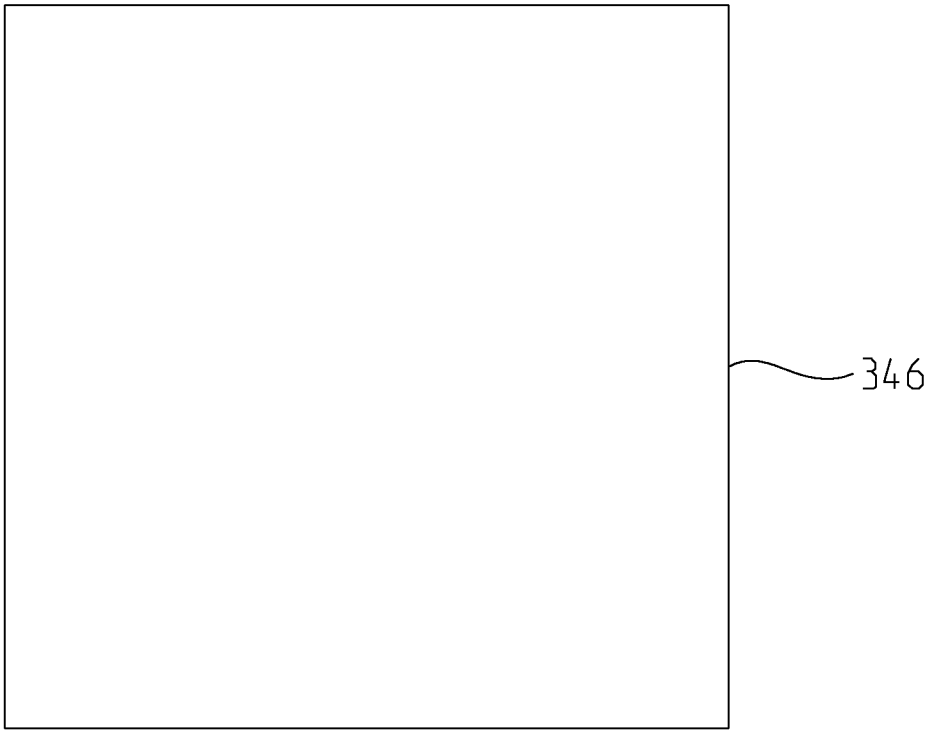
FIG. 47 is a plan view of the base pad of FIG. 35.

With reference to FIGS. 35 and 47, the bottom wall 326 of the carton 318 is formed by flaps 336, 338, 340, and 342 defining a recess 344. A base pad 346 is received within the recess 344 and is illustratively formed of corrugated cardboard. The base pad 346 provides a level surface for internal components of the carton 318.

Figure 36:
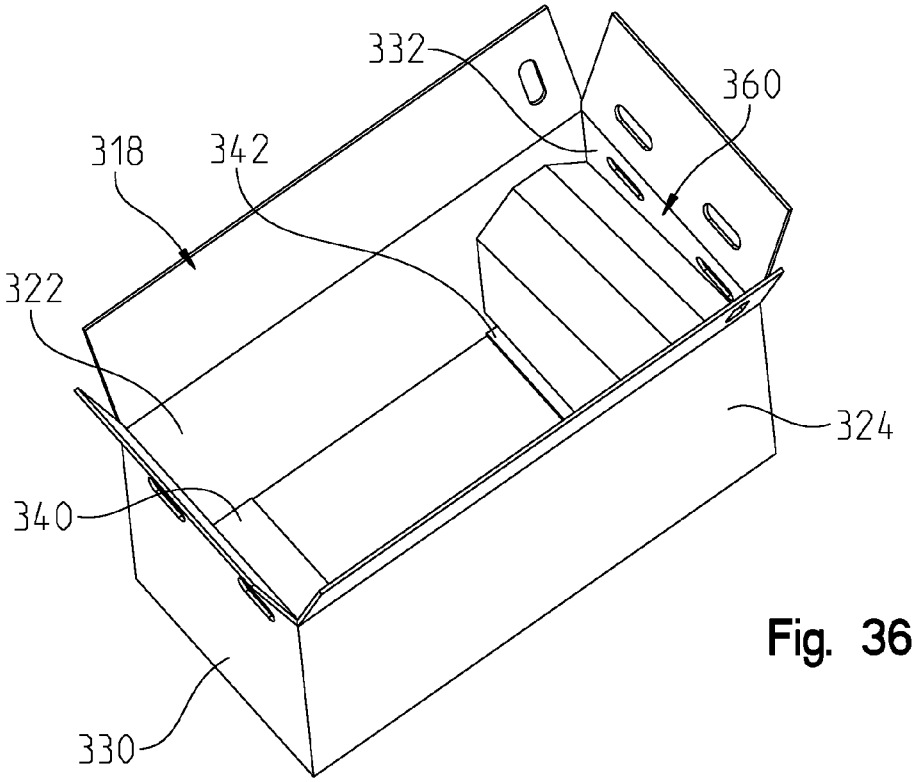
FIG. 36 is a perspective view showing a toilet tank package placed within the carton of FIG. 35.
Figure 48:
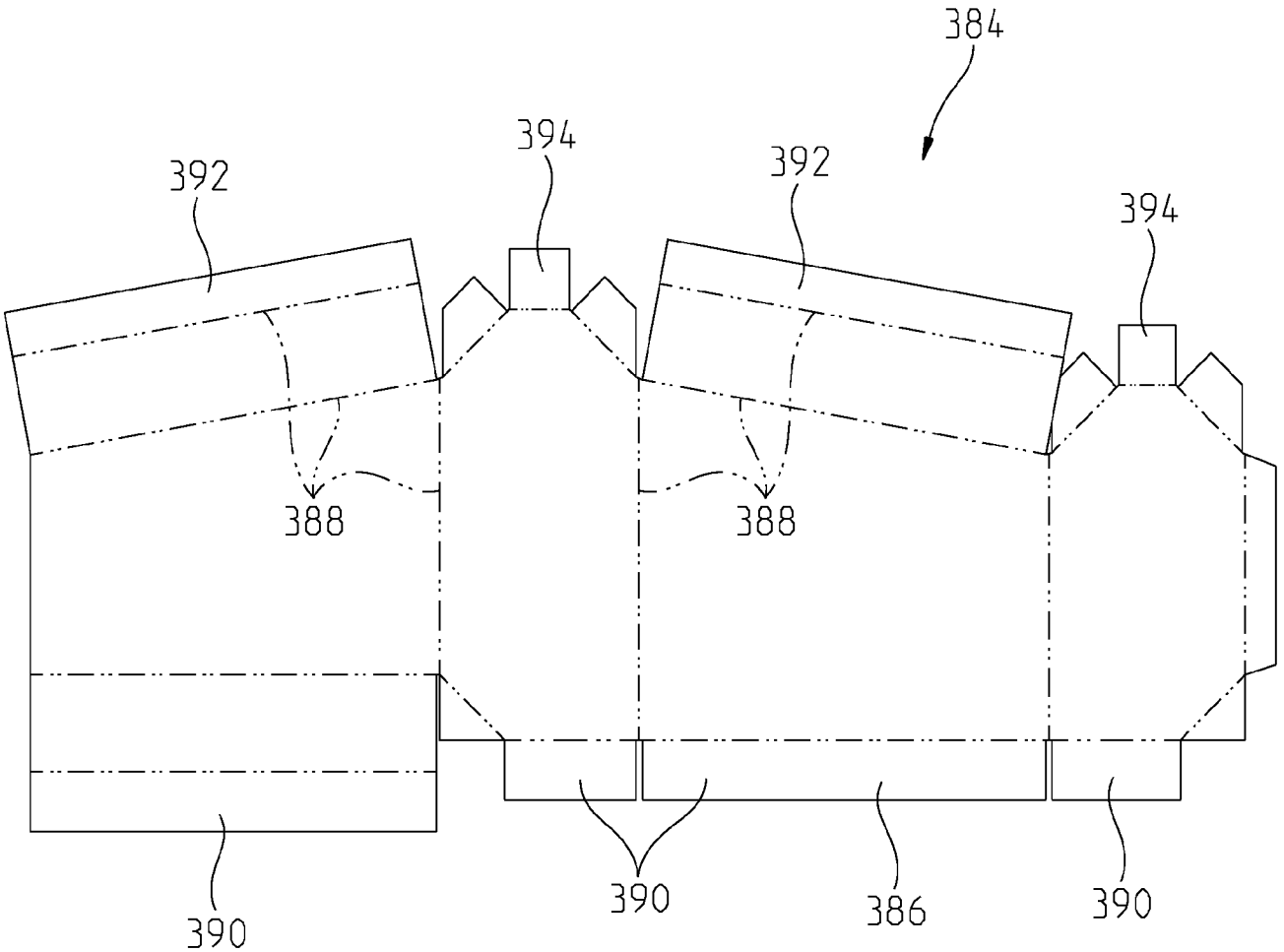
FIG. 48 is a plan view of an unfolded cardboard blank for use in making the illustrative tank carton of FIG. 36.

With reference to FIGS. 36 and 48, a tank package 360 is illustratively placed above flap 342 adjacent end wall 332. Tank package 360 may be similar to tank package 60' as shown in FIGS. 29-33. With further reference to FIG. 48, the tank package 360 illustratively includes a tank carton 384 formed from a corrugated cardboard blank 386. The cardboard blank 386 is folded along score or fold lines 388 to define the tank carton 384 for receiving and protecting the toilet tank 14. Flaps 390 and 392 cooperate with each other to form an enclosed carton 384 that may be secured around the tank 14 through conventional adhesive tape.

Figure 37:
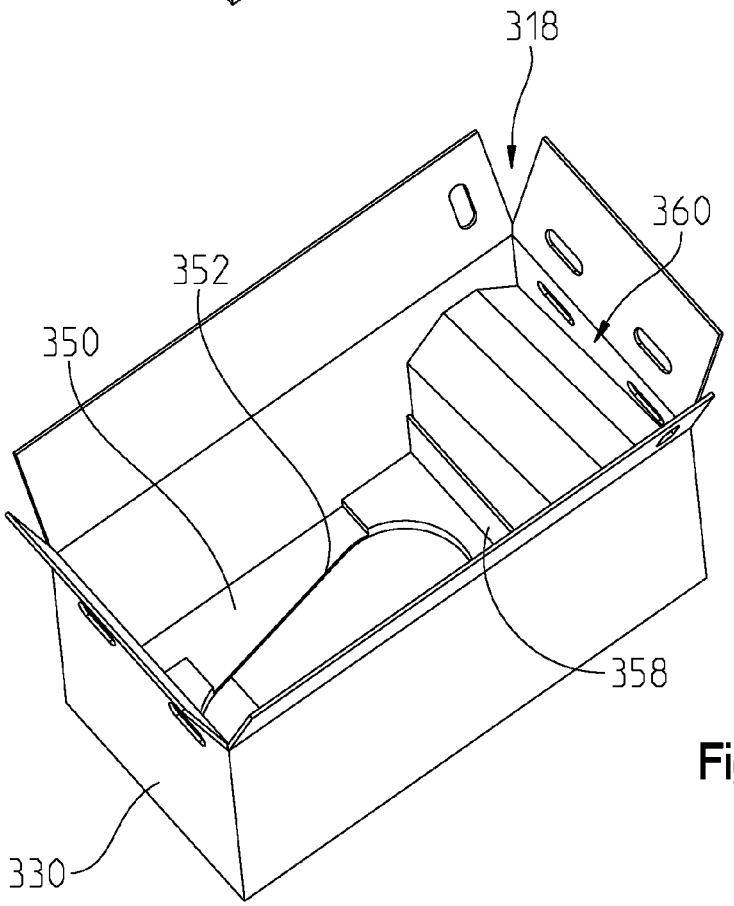
FIG. 37 is a perspective view showing a location fitment placed within the carton of FIG. 36.
Figure 49:
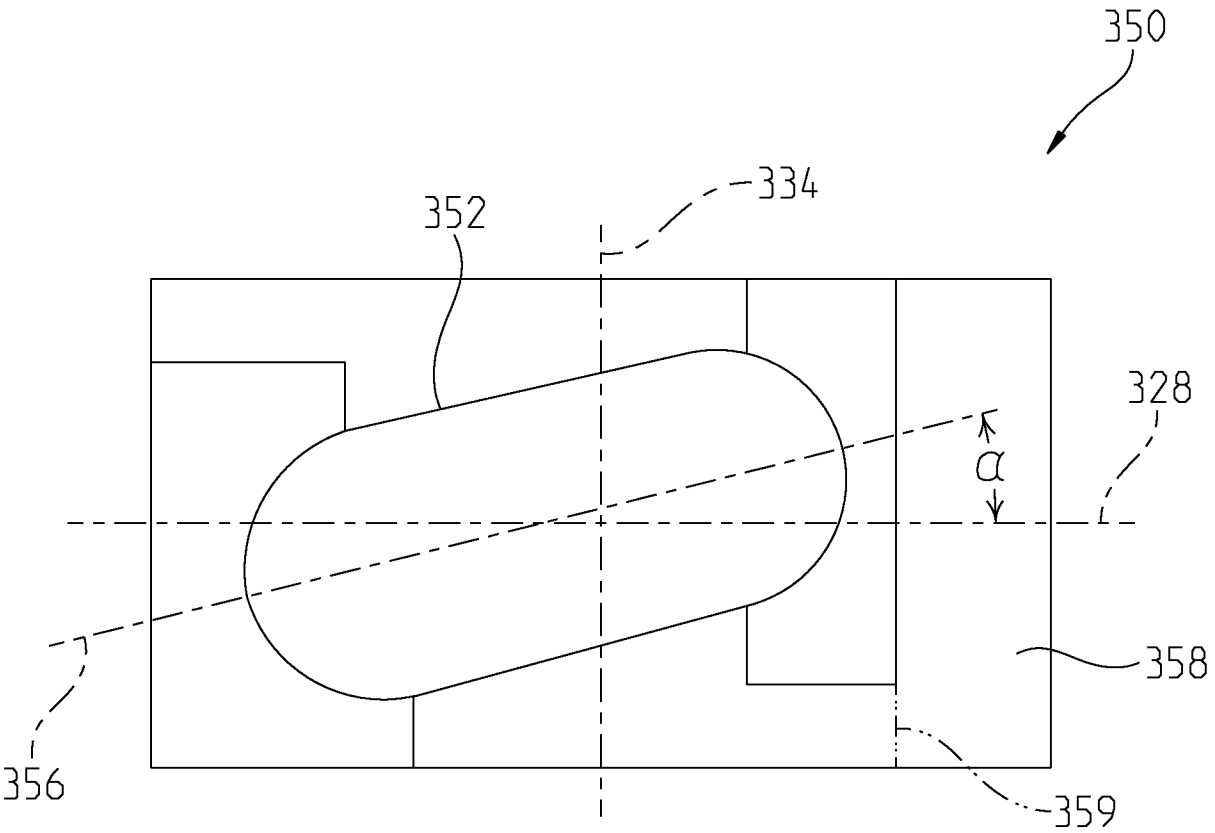
FIG. 49 a plan view of the location fitment of FIG. 37.

With reference to FIGS. 37 and 49, a location fitment 350 is supported above the bottom wall 326 and the base pad 346. The location fitment 350 is illustratively formed of corrugated cardboard, and includes an opening 352 for receiving and orienting a lower portion or mounting base 54 of the toilet bowl 12. The opening 352 is configured to orient the toilet bowl 12 at an angle intermediate the carton longitudinal axis 328 and the carton lateral axis 334. In one illustrative embodiment, the angle $\alpha$ between the location fitment longitudinal axis 356 of the opening 352 and the carton longitudinal axis 328 as shown in FIG. 49 is approximately 13 degrees. A locator flap 358 may be folded at an end of the location fitment 350 along a score or fold line 359, and when assembled rests against tank package 360.

Figure 38:
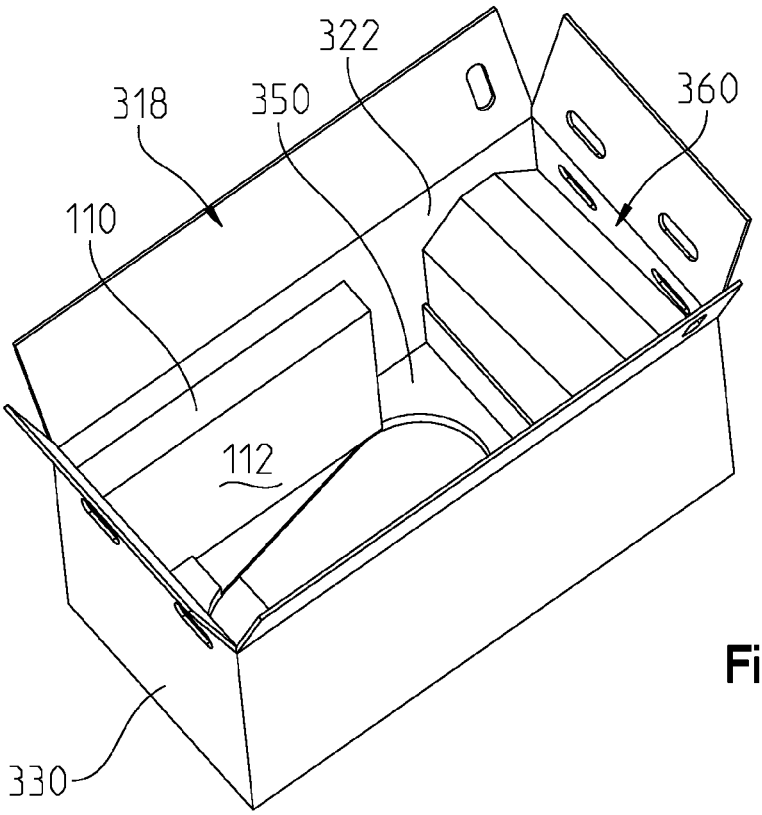
FIG. 38 is a perspective view showing a toilet seat pack placed within the carton of FIG. 37.

Referring now to FIG. 38, a toilet seat pack 110 receives a conventional toilet seat (not shown) and is positioned adjacent the first side wall 322 of the carton 318 above the location fitment 350. The toilet seat pack 110 is illustratively formed of a folded cardboard blank 112, sized and shaped to receive a conventional toilet seat configured to be supported on the toilet bowl 12.

Figure 39:
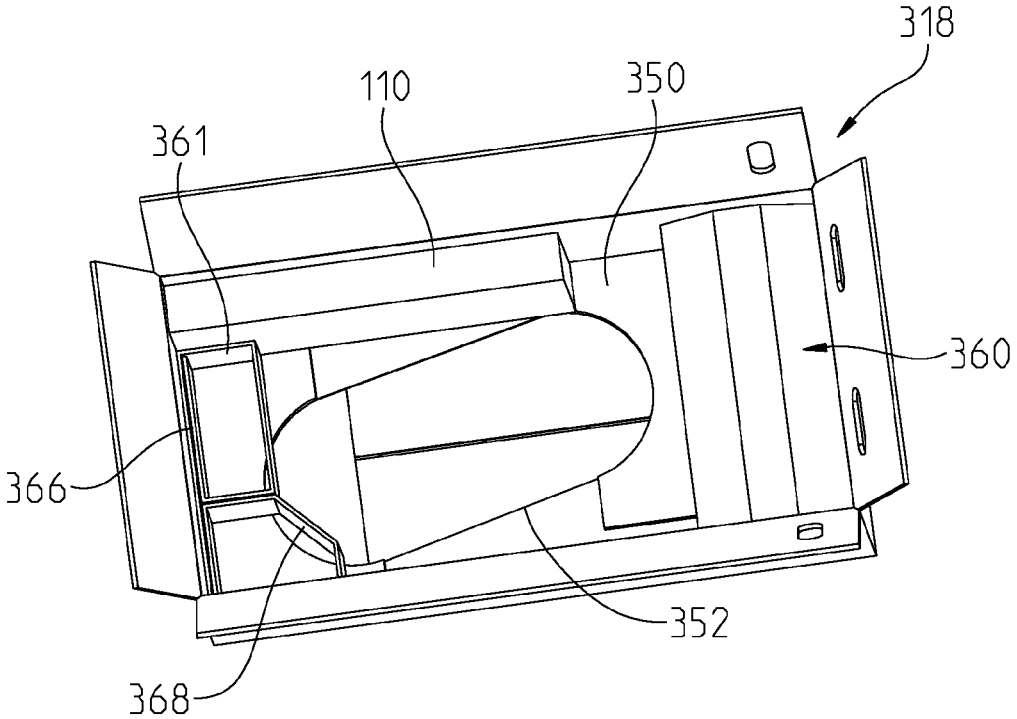
FIG. 39 is a perspective view showing a bowl fitment placed adjacent to an end wall of the carton of FIG. 38.
Figure 40:
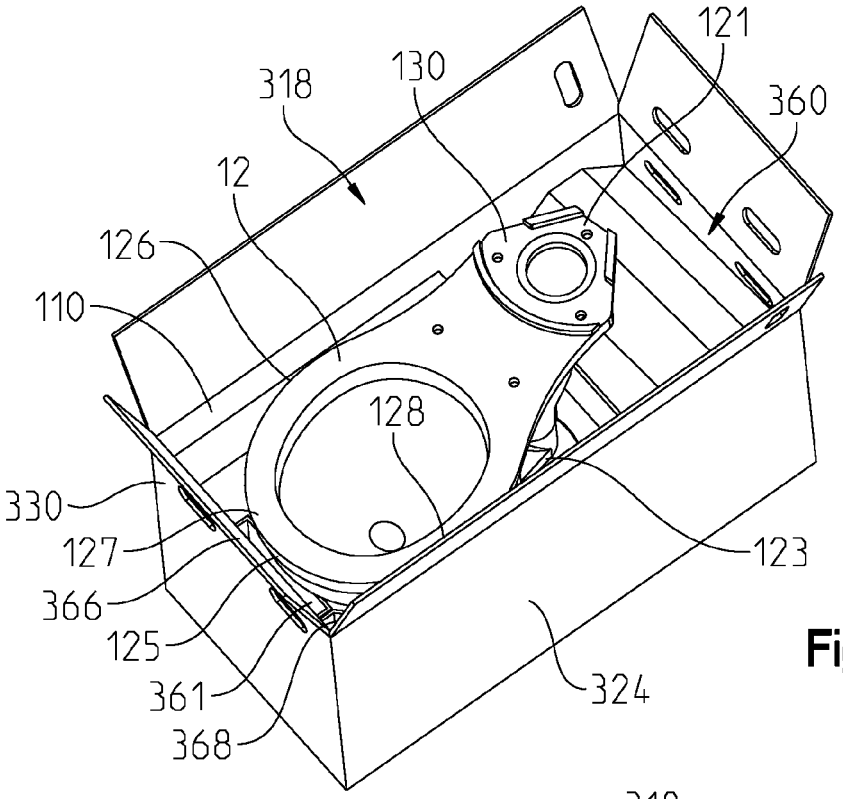
FIG. 40 is a perspective view showing a toilet bowl placed within the carton of FIG. 39.
Figure 50:
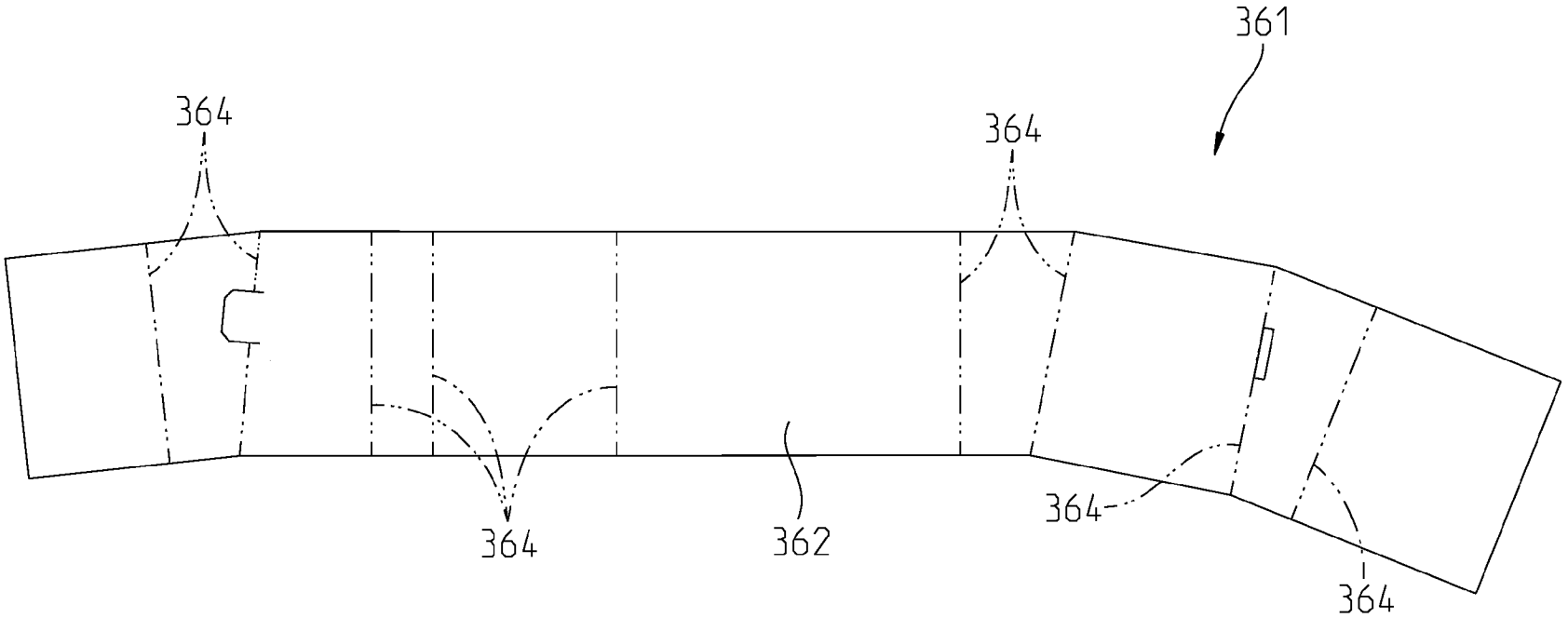
FIG. 50 is a plan view of an unfolded cardboard blank used in making the bowl fitment of FIG. 39.

With reference to FIGS. 39, 40 and 50, a bowl fitment 361 is positioned intermediate front end 125 of the toilet bowl 12 and a corner defined by walls 324 and 330 of the carton 318. The bowl fitment 361 is illustratively formed of a corrugated cardboard blank 362. The cardboard blank 362 is folded along score or fold lines 364 to define the bowl fitment 361. The bowl fitment 361 illustratively includes a main rectangular body 366 and an angled extension 368. The extension 368 is received within the corner defined by walls 324 and 330, such that the body 366 and the extension 368 together cradle the toilet bowl 12.

As shown in FIG. 40, the mounting base or foot 54 of the toilet bowl 12 is properly located within the carton 18 by being received within the opening 352 of the location fitment 350. A front end 125 of the toilet bowl 12, illustratively defined by the toilet bowl rim 127, is positioned adjacent to and illustratively contacts the main rectangular body 366 of the bowl fitment 361. A first side 126 of the toilet bowl 12 is positioned adjacent to and illustratively contacts the toilet seat pack 110. A second side 128 of the toilet bowl 12 is positioned adjacent to and illustratively contacts the angled extension 368 of the bowl fitment 361. A rear end 121 of the toilet bowl 12, defined by a tank mounting shelf 130, illustratively contacts the tank package 360.

Figure 41:
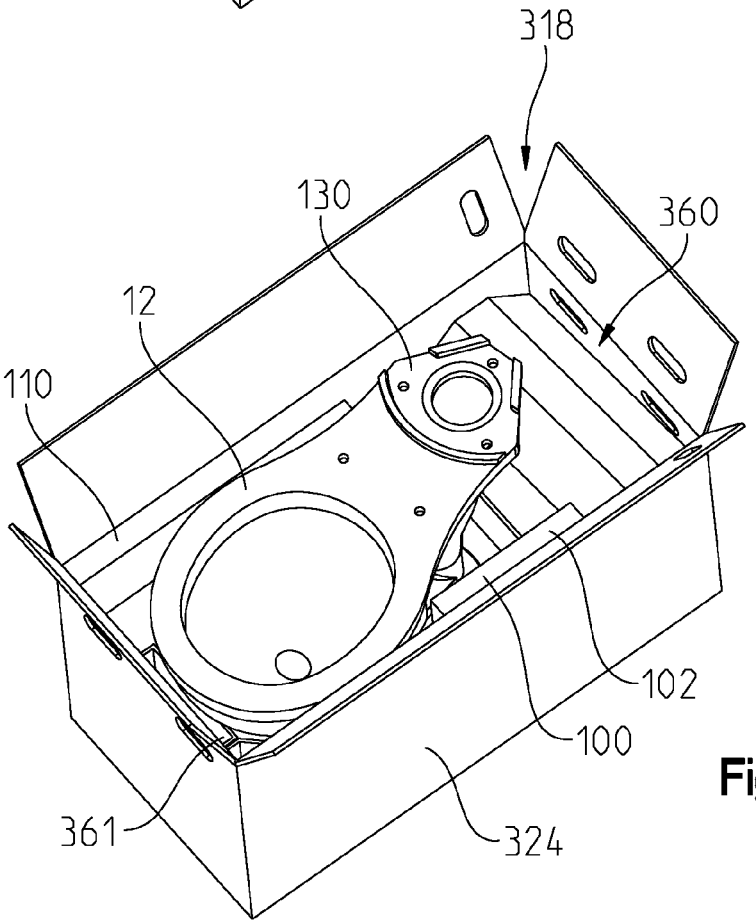
FIG. 41 is a perspective view showing a tank lid pack placed within the carton FIG. 6; toilet end fitment placed within the carton of FIG. 40.
Figure 42:
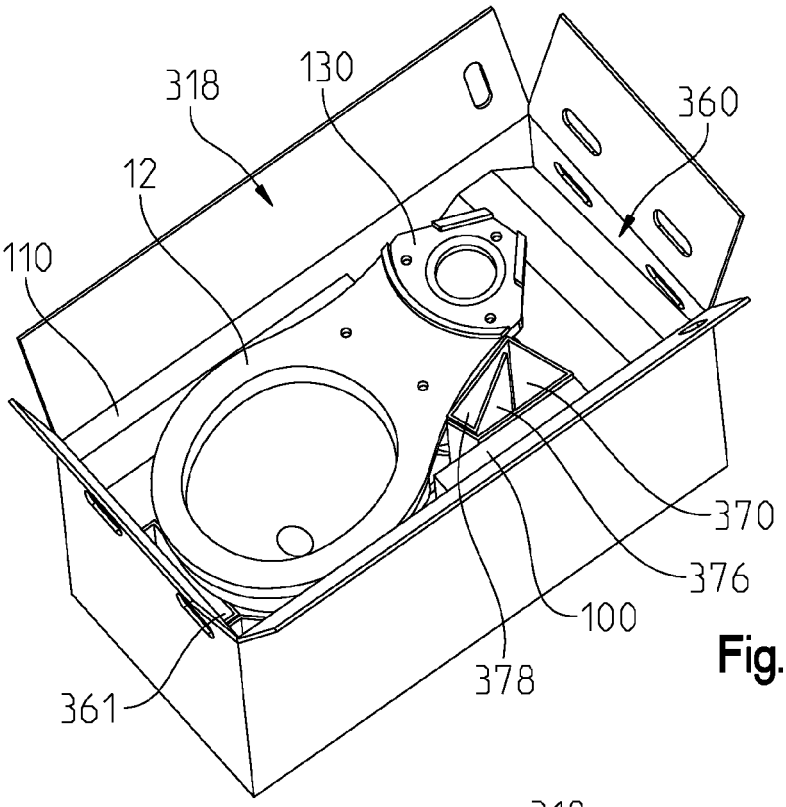
FIG. 42 is a perspective view showing a tank lid fitment placed within the carton of FIG. 41.
Figure 51A:
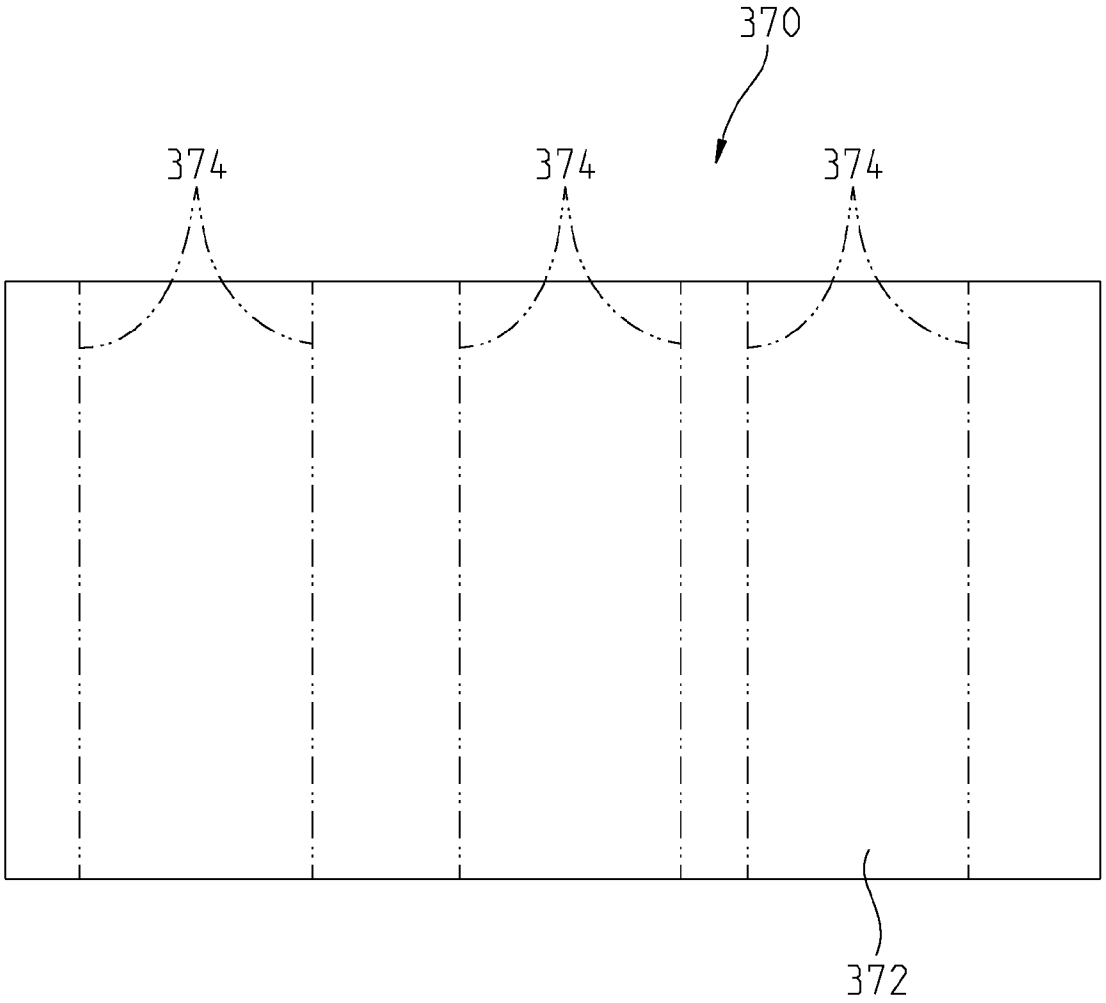
FIG. 51A is a plan view of an unfolded cardboard blank used in making the tank lid fitment of FIG. 42.
Figure 51B:
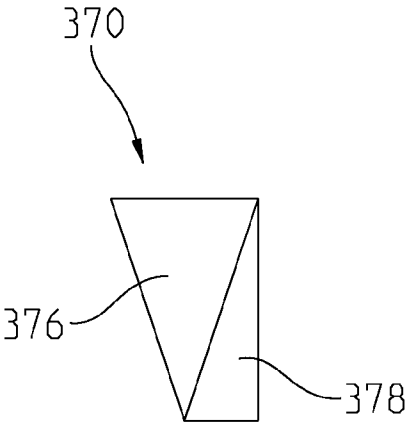
FIG. 51B is a top plan view of the cardboard blank of FIG. 51A folded into the tank lid fitment of FIG. 42.

With reference to FIG. 41, tank lid pack 100, which receives the tank lid 16, is positioned adjacent the second side wall 324 of the carton 318, intermediate the shelf 130 and the tank package 360. As shown in FIGS. 42, 51A and 51B, a tank lid fitment 370 is positioned intermediate the tank lid pack 100, the toilet bowl 12 and the tank package 360. The tank lid fitment 370 is illustratively formed of a corrugated cardboard blank 372. The cardboard blank 372 is folded along score or fold lines 374 to define the tank lid fitment 370 for securing and protecting the toilet bowl 12. The tank lid fitment 370 illustratively includes a first and second triangular bodies 376 and 378 positioned adjacent the tank lid pack 100 and the toilet shelf 130, respectively. As shown in FIG. 43, accessory pack 148 may be received within the toilet bowl 12 and includes a box 150 containing mounting hardware, installation instructions, etc.

Figure 52:
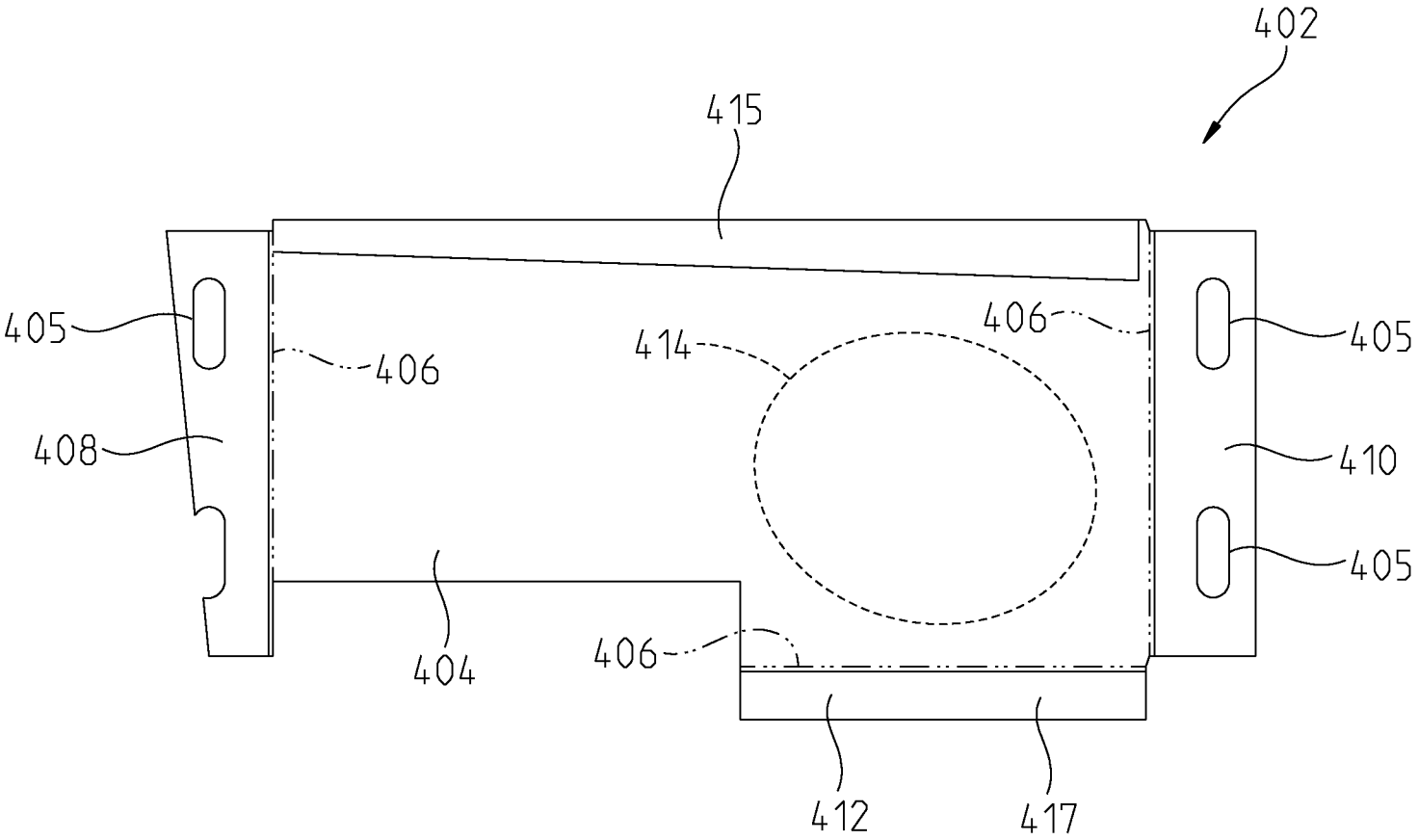
FIG. 52 is a plan view of an unfolded cardboard blank used in making the bowl top fitment of FIG. 44.

Referring now to FIGS. 44 and 52, a bowl or large top fitment 402 is placed above the toilet bowl 12. The bowl top fitment 402 is illustratively formed of a corrugated cardboard blank 404. The cardboard blank 404 is folded along score or fold lines 406 to define flaps 408, 410 and 412. Handholds 405 may be formed within the flaps 408 and 410. A locator 414 is supported by a lower surface of the blank 404 for locating the fitment 402 within the bowl 12. Reinforcing strips 415 and 417 are supported by the lower surface of the blank 404 along opposing side edges. The bowl top fitment 402 illustratively defines a notch or recess 416 for accessing the interior of the carton 318.

With reference to FIG. 45, upper flaps 418 and 420 of the carton 318 are folded to close the upper opening above the top fitment 402. The flaps 418 and 420 may be secured in place through conventional means, such as adhesive tape (not shown). Once the carton 318 has been sealed, it may be transported and/or stored on the end wall 330 as desired for improved storage capacity.

The illustrative packaging systems 10, 310 detailed herein may be used with a wide variety of sanityware. In certain illustrative embodiments, the packaging system 10, 310 is configured to accommodate toilet tanks 14 having outer or envelope dimensions with lengths ranging from approximately 15.8 inches to approximately 16.5 inches, widths ranging from approximately 7.7 inches to approximately 8.0 inches, and heights of approximately 14.2 inches. Similarly, the illustrative packaging system is configured to accommodate toilet bowls 12 having outer or envelope dimensions with lengths ranging from approximately 27.0 inches to approximately 30.0 inches, widths ranging from approximately 14.0 inches to approximately 14.4 inches, and heights of approximately 16.5 inches.

Although the invention has been described in detail with reference to certain preferred embodiments, variations and modifications exist within the spirit and scope of the invention as described and defined in the following claims.

The invention claimed is:

1. A packaging system for toilet components comprising:

an outer carton including a bottom wall, opposing first and second side walls extending upwardly from the bottom wall, a front end wall extending between the first and second side walls, and a rear end wall in spaced relation to the front end wall and extending between the first and second side walls, wherein a carton longitudinal axis extends substantially parallel to the first and second side walls, and a carton lateral axis extends perpendicular to the carton longitudinal axis;

a location fitment supported above the bottom wall of the outer carton and configured to orient a mounting base of a toilet bowl within the outer carton;

a tank protective member supported within the outer carton and configured to be positioned intermediate the toilet bowl and a toilet tank;

a tank lid pack positioned intermediate the front end wall of the outer carton and a front of the toilet bowl;

a toilet seat pack positioned intermediate the first side wall of the outer carton and a first side of the toilet bowl;

a toilet end fitment positioned intermediate the rear end wall of the outer carton and a rear of the toilet bowl;

a tank lid fitment positioned intermediate the second side wall of the outer carton and a second side of the toilet bowl; and a top bowl fitment positioned above the toilet bowl.

2. The packaging system of claim 1, further comprising an accessory pack positioned within a chamber defined by the tank lid fitment.

3. The packaging system of claim 1, further comprising a tank outlet fitment positioned on a lower end of the toilet tank.

4. The packaging system of claim 3, further comprising a tank top fitment positioned on the lower end of the toilet tank around the tank outlet fitment.

5. The packaging system of claim 1, wherein the bottom wall of the outer carton includes flaps extending from the front end wall and the rear end wall, a recess defined between the flaps, and a base pad positioned within the recess below the location fitment.

6. The packaging system of claim 1, wherein the outer carton, the location fitment, the tank protective member, the toilet end fitment, the tank lid fitment, and the top bowl fitment are formed of corrugated cardboard.

7. The packaging system of claim 1, wherein the tank protective member comprises a tank carton enclosing the toilet tank.

8. The packaging system of claim 7, wherein the tank carton includes an angled flap defining an inclined corner to accommodate the toilet bowl.

9. The packaging system of claim 1, wherein the location fitment includes an opening configured to receive the mounting base of the toilet bowl, the opening defining a location fitment longitudinal axis, the location fitment longitudinal axis being angled relative to the carton longitudinal axis by an acute angle.

10. A packaging system for toilet components comprising:

an outer carton including a bottom wall formed by folded flaps defining a support surface, opposing first and second side walls extending upwardly from the bottom wall, a front end wall extending between the first and second side walls, and a rear end wall in spaced relation to the front end wall and extending between the first and second side walls, wherein a carton longitudinal axis extends substantially parallel to the first and second side walls, and a carton lateral axis extends perpendicular to the carton longitudinal axis; and a location fitment formed of corrugated cardboard extending parallel to the support surface and supported above the bottom wall of the outer carton, the corrugated cardboard of the location fitment including an opening configured to receive and orient a mounting base of a toilet bowl within the outer carton, the opening defining a location fitment longitudinal axis;

wherein the location fitment longitudinal axis is angled relative to the carton longitudinal axis by an acute angle.

11. The packaging system of claim 10, further comprising a toilet seat pack positioned intermediate the first side wall of the outer carton and a first side of the toilet bowl.

12. The packaging system of claim 11, further comprising a tank lid fitment positioned intermediate the second side wall of the outer carton and a second side of the toilet bowl.

13. The packaging system of claim 10, further comprising a top bowl fitment positioned above the toilet bowl.

14. The packaging system of claim 10, further comprising:

a tank lid pack positioned intermediate the front end wall of the outer carton and a front of the toilet bowl; and a toilet end fitment positioned intermediate the rear end wall of the outer carton and a rear of the toilet bowl.

15. The packaging system of claim 14, further comprising a tank protective member supported within the outer carton and configured to be positioned intermediate the toilet bowl and a toilet tank.

16. The packaging system of claim 15, wherein the tank protective member comprises a tank carton enclosing the toilet tank.

17. A packaging system for toilet components comprising:

an outer carton including a bottom wall defining a support surface, opposing first and second side walls extending upwardly from the bottom wall, a front end wall extending between the first and second side walls, and a rear end wall in spaced relation to the front end wall and extending between the first and second side walls, wherein a carton longitudinal axis extends substantially parallel to the first and second side walls, and a carton lateral axis extends perpendicular to the carton longitudinal axis;

a location fitment extending parallel to the support surface and supported above the bottom wall of the outer carton, the location fitment including an opening configured to receive and orient a mounting base of a toilet bowl within the outer carton, the opening defining a location fitment longitudinal axis, wherein the location fitment longitudinal axis is angled relative to the carton longitudinal axis by an acute angle;

a tank protective member supported within the outer carton and configured to be positioned intermediate the toilet bowl and a toilet tank;

a tank lid pack positioned intermediate the front end wall of the outer carton and a front of the toilet bowl;

a toilet seat pack positioned intermediate the first side wall of the outer carton and a first side of the toilet bowl; and a top bowl fitment positioned above the toilet bowl.

18. The packaging system of claim 17, further comprising a toilet end fitment positioned intermediate the rear end wall of the outer carton and a rear of the toilet bowl.

19. The packaging system of claim 18, further comprising a tank lid fitment positioned intermediate the second side wall of the outer carton and a second side of the toilet bowl.

20. The packaging system of claim 17, wherein the tank protective member comprises a tank carton enclosing the toilet tank.

* * * * *